US010054864B2

(12) United States Patent
Murayama et al.

(10) Patent No.: US 10,054,864 B2
(45) Date of Patent: Aug. 21, 2018

(54) TONER, TONER STORED UNIT, AND IMAGE FORMING APPARATUS

(71) Applicants: Tomoki Murayama, Kanagawa (JP); Ryota Inoue, Shizuoka (JP); Masana Shiba, Shizuoka (JP); Daisuke Inoue, Shizuoka (JP); Junichi Awamura, Shizuoka (JP); Yoshitsugu Kimura, Kanagawa (JP); Rintaro Takahashi, Kanagawa (JP)

(72) Inventors: Tomoki Murayama, Kanagawa (JP); Ryota Inoue, Shizuoka (JP); Masana Shiba, Shizuoka (JP); Daisuke Inoue, Shizuoka (JP); Junichi Awamura, Shizuoka (JP); Yoshitsugu Kimura, Kanagawa (JP); Rintaro Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/986,943

(22) Filed: Jan. 4, 2016

(65) Prior Publication Data

US 2016/0195827 A1 Jul. 7, 2016

(30) Foreign Application Priority Data

Jan. 5, 2015 (JP) ..... 2015-000400
Nov. 30, 2015 (JP) ..... 2015-232980

(51) Int. Cl.

| | |
|---|---|
| ***G03G 9/087*** | (2006.01) |
| ***G03G 15/00*** | (2006.01) |
| ***G03G 15/01*** | (2006.01) |

(52) U.S. Cl.
CPC ..... *G03G 9/08755* (2013.01); *G03G 15/00* (2013.01); *G03G 15/0126* (2013.01)

(58) Field of Classification Search
CPC ..... G03G 9/08755; G03G 15/0126; G03G 9/08797
See application file for complete search history.

(56) References Cited

U.S. PATENT DOCUMENTS 7,374,851 B2 5/2008 Nakayama et al.
7,449,273 B2 11/2008 Ohki et al.
(Continued)

FOREIGN PATENT DOCUMENTS

JP 2004-295110 10/2004
JP 2005-234046 9/2005
(Continued)

OTHER PUBLICATIONS

U.S. Appl. No. 14/669,230, filed Mar. 26, 2015.

*Primary Examiner* — Thorl Chea
(74) *Attorney, Agent, or Firm* — Oblon, McClelland, Maier & Neustadt, L.L.P.

(57) ABSTRACT

A toner including a binder resin, wherein a toner extract obtained by drying an extraction liquid obtained through Soxhlet extraction of the toner with tetrahydrofuran (THF) has glass transition temperature Tg in a range of from 35° C. through 55° C., and a moisture-content change rate of the toner extract before and after leaving the toner extract to stand for 3 days in an environment of 40° C. and 70% RH is 0.5% or less, and wherein a specific-surface-area change rate of the toner before and after leaving the toner to stand for 3 days in an environment of 40° C. and 70% RH is in a range of from 15% through 50%.

5 Claims, 9 Drawing Sheets

(56) References Cited

U.S. PATENT DOCUMENTS 7,459,255 B2 12/2008 Tanaka et al.
7,504,188 B2 3/2009 Yamada et al.
7,531,279 B2 5/2009 Watanabe et al.
8,026,031 B2 9/2011 Watanabe et al.
8,263,302 B2 9/2012 Moriya et al.
8,367,293 B2 2/2013 Ohtani et al.
8,673,528 B2 3/2014 Sugimoto et al.
8,735,037 B2 5/2014 Yamashita et al.
8,778,588 B2 7/2014 Kusahara et al.
8,835,086 B2 9/2014 Watanabe et al.
8,877,420 B2 11/2014 Tanaka et al.
9,023,570 B2 5/2015 Shiba et al.
9,069,288 B2 6/2015 Kojima et al.
9,152,084 B2 10/2015 Shiba et al.
2003/0134215 A1* 7/2003 Kashiwabara ..... G03G 9/08704 430/108.4
2004/0146795 A1 7/2004 Emoto et al.
2004/0209181 A1 10/2004 Higuchi et al.
2004/0229147 A1 11/2004 Higuchi et al.
2004/0265721 A1 12/2004 Matsuoka et al.
2005/0026066 A1 2/2005 Tanaka et al.
2005/0031980 A1 2/2005 Inoue et al.
2005/0112488 A1 5/2005 Yamada et al.
2005/0164112 A1 7/2005 Ohki et al.
2005/0180786 A1 8/2005 Yamada et al.
2005/0186498 A1 8/2005 Honda et al.
2006/0024097 A1 2/2006 Yamada et al.
2006/0057488 A1 3/2006 Inoue et al.
2006/0068312 A1 3/2006 Yamashita et al.
2006/0099529 A1 5/2006 Tanaka et al.
2006/0160011 A1 7/2006 Inoue et al.
2006/0210903 A1 9/2006 Ohki et al.
2007/0054210 A1 3/2007 Ohki et al.
2007/0059626 A1 3/2007 Inoue et al.
2007/0141500 A1 6/2007 Sugimoto et al.
2007/0141506 A1 6/2007 Inoue et al.
2007/0218380 A1 9/2007 Uchinokura et al.
2007/0218381 A1 9/2007 Uchinokura et al.
2007/0218382 A1 9/2007 Emoto et al.
2008/0063972 A1 3/2008 Inoue et al.
2008/0070148 A1 3/2008 Awamura et al.
2008/0076055 A1 3/2008 Sawada et al.
2008/0138734 A1 6/2008 Inoue et al.
2008/0213682 A1 9/2008 Saitoh et al.
2008/0226998 A1 9/2008 Ishii et al.
2008/0227018 A1 9/2008 Awamura et al.
2008/0268366 A1 10/2008 Nakayama et al.
2008/0280218 A1 11/2008 Sabu et al.
2008/0280219 A1 11/2008 Nakayama et al.
2008/0280224 A1 11/2008 Inoue et al.
2008/0292361 A1 11/2008 Seshita et al.
2008/0298834 A1* 12/2008 Hasegawa ..... G03G 15/0877 399/106
2008/0311500 A1 12/2008 Yamada et al.
2009/0010687 A1 1/2009 Yamada et al.
2009/0017392 A1 1/2009 Higuchi et al.
2009/0061345 A1 3/2009 Yamada et al.
2009/0117480 A1 5/2009 Yamada et al.
2009/0142094 A1 6/2009 Sawada et al.
2009/0142680 A1 6/2009 Shimota et al.
2009/0142682 A1 6/2009 Saitoh et al.
2009/0142690 A1 6/2009 Awamura et al.
2009/0162770 A1 6/2009 Sako et al.
2009/0186292 A1 7/2009 Inoue et al.
2009/0202935 A1 8/2009 Moriya et al.
2009/0214975 A1 8/2009 Awamura et al.
2009/0226836 A1 9/2009 Uchinokura et al.
2009/0269692 A1 10/2009 Awamura et al.
2009/0280421 A1 11/2009 Awamura et al.
2010/0062352 A1 3/2010 Kusahara et al.
2010/0104965 A1 4/2010 Inoue et al.
2010/0129748 A1 5/2010 Inoue et al.
2010/0183967 A1 7/2010 Sabu et al.
2010/0209838 A1 8/2010 Kusahara et al.
2010/0216068 A1 8/2010 Kotsugai et al.
2010/0233609 A1 9/2010 Higuchi et al.
2010/0310980 A1 12/2010 Sugimoto et al.
2010/0330489 A1 12/2010 Inoue et al.
2011/0003244 A1 1/2011 Inoue et al.
2011/0033794 A1 2/2011 Watanabe et al.
2011/0065033 A1 3/2011 Uchinokura et al.
2011/0065036 A1 3/2011 Inoue et al.
2011/0076610 A1 3/2011 Ogawa et al.
2011/0076612 A1 3/2011 Awamura et al.
2011/0086308 A1 4/2011 Watanabe et al.
2011/0104608 A1 5/2011 Nakajima et al.
2011/0124838 A1 5/2011 Kotsugai et al.
2011/0129773 A1 6/2011 Shu et al.
2011/0151370 A1 6/2011 Shitara et al.
2011/0200929 A1 8/2011 Karato et al.
2011/0223530 A1 9/2011 Inoue et al.
2011/0223532 A1 9/2011 Sugimoto et al.
2011/0255899 A1 10/2011 Iwamoto et al.
2011/0262853 A1 10/2011 Watanabe et al.
2011/0262856 A1 10/2011 Sugimoto et al.
2011/0281213 A1 11/2011 Sakashita et al.
2011/0294058 A1 12/2011 Shiba et al.
2011/0305986 A1 12/2011 Ogawa et al.
2011/0318053 A1 12/2011 Yamashita et al.
2012/0014714 A1* 1/2012 Shu ..... G03G 9/0804 399/159
2012/0064445 A1 3/2012 Kojima et al.
2012/0189951 A1 7/2012 Sugimoto et al.
2012/0219896 A1 8/2012 Asahina et al.
2012/0288299 A1 11/2012 Uchinokura et al.
2012/0295193 A1 11/2012 Hanatani et al.
2012/0328976 A1 12/2012 Seki et al.
2013/0011778 A1 1/2013 Yamashita et al.
2013/0011779 A1* 1/2013 Yamashita ..... G03G 9/0806 430/109.4
2013/0059247 A1 3/2013 Sugimoto et al.
2013/0095422 A1 4/2013 Yamamoto et al.
2013/0130171 A1 5/2013 Watanabe et al.
2013/0157184 A1 6/2013 Sugimoto et al.
2013/0157193 A1 6/2013 Moritani et al.
2013/0164669 A1 6/2013 Yamashita et al.
2013/0171554 A1 7/2013 Yamashita et al.
2013/0196260 A1 8/2013 Yoshida et al.
2013/0196261 A1 8/2013 Uchinokura et al.
2013/0196263 A1* 8/2013 Asahina ..... G03G 9/08755 430/109.4
2013/0224648 A1 8/2013 Honda et al.
2013/0243484 A1* 9/2013 Toda ..... G03G 21/0017 399/159
2013/0243488 A1 9/2013 Kojima et al.
2013/0244155 A1 9/2013 Satoh et al.
2013/0244156 A1 9/2013 Kojima et al.
2013/0244157 A1 9/2013 Inoue et al.
2013/0244158 A1 9/2013 Awamura et al.
2013/0330522 A1 12/2013 Suzuki et al.
2014/0072349 A1 3/2014 Sakashita et al.
2014/0080046 A1 3/2014 Asahina et al.
2014/0080047 A1 3/2014 Takahashi et al.
2014/0093820 A1 4/2014 Satoh et al.
2014/0140731 A1 5/2014 Hozumi et al.
2014/0220485 A1 8/2014 Kojima et al.
2014/0234767 A1 8/2014 Awamura et al.
2014/0242514 A1 8/2014 Inoue et al.
2014/0272689 A1 9/2014 Yamashita et al.
2014/0272695 A1 9/2014 Moritani et al.
2014/0363209 A1 12/2014 Inoue et al.
2014/0377700 A1* 12/2014 Mine ..... G03G 9/08755 430/109.4
2015/0024312 A1 1/2015 Shiba et al.
2015/0037718 A1 2/2015 Morita et al.
2015/0104739 A1 4/2015 Nagatomo et al.
2015/0198902 A1 7/2015 Saito et al.
2015/0220011 A1 8/2015 Miyaake et al.
2015/0234303 A1 8/2015 Moriya et al.
2015/0234304 A1 8/2015 Nagata et al.
2015/0241804 A1 8/2015 Takahashi et al.
2015/0253687 A1 9/2015 Chiba et al.

(56) References Cited

U.S. PATENT DOCUMENTS

| | | | |
|---|---|---|---|
| 2015/0261111 | A1 | 9/2015 | Inoue et al. |
| 2015/0261144 | A1 | 9/2015 | Sakashita et al. |

FOREIGN PATENT DOCUMENTS

| | | | |
|---|---|---|---|
| JP | 2012-108462 | | 6/2012 |
| JP | 2014-163949 | | 9/2014 |
| WO | WO2010/143385 | A1 | 12/2010 |

* cited by examiner

TONER, TONER STORED UNIT, AND IMAGE FORMING APPARATUS

CROSS-REFERENCE TO RELATED APPLICATIONS

The present application claims priority under 35 U.S.C. § 119 to Japanese Patent Application No. 2015-000400, filed Jan. 5, 2015 and Japanese Patent Application No. 2015-232980, filed Nov. 30, 2015. The contents of which are incorporated herein by reference in their entirety.

BACKGROUND OF THE INVENTION

Field of the Invention

The present disclosure relates to toners, toner stored units, and image forming apparatuses.

Description of the Related Art

In image forming apparatuses, such as an electrophotographic device, and an electrostatic recording device, a toner is deposited on an electrostatic latent image formed on a photoconductor to form a toner image, and the toner image is transferred to a recording medium, followed by heating to fix the toner image.

When a full-color image is formed, moreover, fixing is performed by heating, after overlapping toner images of each of 4 colors, typically using toners of 4 colors, black, yellow, magenta, and cyan. As the technology of electrophotography develops, the aforementioned toner is required to have low temperature fixing ability, and storage stability.

To meet the aforementioned demands, low temperature fixing ability of a toner is achieved with low viscosity or low glass transition temperature of a binder resin for use. However, such a toner has problems, such as reduction in blocking resistance of a toner, reduction in storage stability of a toner in high temperature high humidity environment, and low charge due to a change caused on surfaces of toner particles.

To solve the aforementioned problems, recently proposed has been an invention associated with a technique using a crystalline resin and an amorphous resin as a binder resin (see Japanese Patent Application Laid-Open (JP-A) Nos. 2005-234046 and 2012-108462). It is disclosed that mainly crystalline polyester is used as a crystalline resin in a toner.

In the aforementioned literatures, low temperature fixing ability of a toner is improved by making crystalline polyester compatible with heat history during fixing, and it is attempted to improve blocking resistance through a selection of a release agent for use, or an adjustment of an amount of a release agent. However, storage stability of a toner in high temperature high humidity environments has not been concerned therein.

Both of the aforementioned literatures mention about an improvement of blocking resistance, and storage stability against high temperature, but storage stability of a toner associated with high humidity has not been sufficiently studied therein. Meanwhile, disclosed is a technique where hydrophobicity of a toner is enhanced by controlling a hydroxyl value of a binder resin for use to overcome reduction in storage stability of the toner in high temperature high humidity environment, or low charge due to a change caused on surfaces of toner particles (see JP-A No. 2004-295110 and WO2010/143385).

In these literatures, there are descriptions that blocking resistance of a toner is improved, an environment hardly affect the toner during image formation, and a toner image of high image quality can be formed on various types of paper. However, the technology disclosed therein does not aim to improve low temperature fixing ability or storage stability of the toner, or to prevent surface changes. Accordingly, there has been a need for a toner, whose low temperature fixing ability or storage stability is improved, and surface changes of which are prevented.

Moreover, there is an attempt to achieve low temperature fixing ability and heat resistant storage stability, and to prevent surface changes after left to stand in a high temperature high humidity environment, through a control method using sol-gel silica of external additives (see JP-A No. 2014-163949), but an improvement has not been achieved with structures of toner base particles.

SUMMARY OF THE INVENTION

The present invention has been accomplished considering the aforementioned problems. The present invention aims to provide a toner, which has excellent low temperature fixing ability, storage stability, and charging stability, as well as storage stability and charging stability that are hardly affected by a temperature and humidity of an atmosphere.

To achieve aforementioned problems, the toner of the present invention includes a binder resin. A toner extract obtained by drying an extraction liquid obtained through Soxhlet extraction of the toner with tetrahydrofuran (THF) has glass transition temperature Tg in a range of from 35° C. through 55° C., and a moisture-content change rate of the toner extract before and after leaving the toner extract to stand for 3 days in an environment of 40° C. and 70% RH is 0.5% or less. In addition, a specific-surface-area change rate of the toner before and after leaving the toner to stand for 3 days in an environment of 40° C. and 70% RH is in a range of from 15% through 50%.

The present invention can provide a toner, which has excellent low temperature fixing ability, storage stability, and charging stability, as well as storage stability and charging stability that are hardly affected by a temperature and humidity of an atmosphere.

DETAILED DESCRIPTION OF THE INVENTION

The toner, toner stored unit, and image forming apparatus according to the present invention are described with reference to drawings hereinafter. Note that, the present invention is not limited to the embodiments described below, and can be changed within a scope, which people skilled in the art can arrive, such as another embodiments, additions, corrections, and deletions. Any of these embodiments is included within a scope of the present invention, as long as it exhibits the functions and effects of the present invention.

(Toner)

The present invention is a toner including at least a binder resin, wherein a toner extract obtained by drying an extraction liquid obtained through Soxhlet extraction of the toner with tetrahydrofuran (THF) has glass transition temperature Tg in a range of from 35° C. through 55° C., and a moisture-content change rate of the toner extract before and after leaving the toner extract to stand for 3 days in an environment of 40° C. and 70% RH is 0.5% or less, and wherein a specific-surface-area change rate of the toner before and after leaving the toner to stand for 3 days in an environment of 40° C. and 70% RH is in a range of from 15% through 50%.

The present invention has the following characteristics, considering that a moisture is present between molecules of a binder resin, when the binder resin, such as a polyester resin, is exposed to a high temperature and high humidity environment, and the moisture is weaken the intermolecular force, to thereby lower thermal properties.

Low temperature fixing ability of the toner is achieved by a toner extract having low glass transition temperature. As for concerning deterioration of storage stability and surface changes, a deterioration of storage stability and changes of toner particle surfaces due to reduction in thermal properties caused by a moisture are prevented by adjusting a moisture-content change rate to 0.5% or less, to thereby less likely to be affected by the environment, where the moisture-content change rate is a moisture-content change rate before and after leaving a toner extract for 3 days in an environment of 40° C. and 70% RH. Moreover, reduction in charge is prevented by adjusting a specific surface area change rate to be in a range of from 15% through 50%. The details are described hereinafter.

Figure 1:
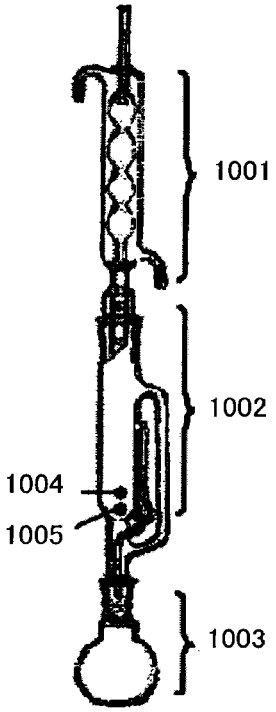
FIG. 1 is a schematic view illustrating one example of Soxhlet extractor.

The toner extract can be obtained by performing Soxhlet extraction of the toner of the present invention with tetrahydrofuran (THF), and drying the extraction liquid obtained by the Soxhlet extraction. As the Soxhlet extraction, methods known in the art can be used. One example of the Soxhlet extractor used for the Soxhlet extraction is illustrated in FIG. 1. In FIG. 1, illustrated are a reflux condenser 1001, an extraction tube 1002, a flask 1003, a sample installation part 1004, and a filtering part 1005. The Soxhlet extraction of the toner with THF is performed by the Soxhlet extractor of FIG. 1, to thereby obtain an extraction liquid. The extraction liquid is then dried to obtain a toner extract.

A method for obtaining the toner extract in the present invention is described through a specific example thereof.

The toner (2 g) is placed in a thimble having an internal diameter of 24 mm, which is then set in the extraction tube. The flask is charged with 200 mL of THF, followed by performing Soxhlet extraction for 10 hours. One set of the flask equipped with the condenser is placed in a heating mantle, and the THF is allowed to reflux at 80° C., to add the THF dripped from the condenser to the toner dropwise. The THF-soluble components (binder resin component) in the toner are allowed to be extracted in the flask to obtain an extraction liquid. The extraction liquid is dried to obtain a toner extract. Note that, a temperature or duration of the drying is not particularly limited, and can be appropriately changed.

In the present invention, the glass transition temperature Tg of the toner extract is in a range of from 35° C. through 55° C. When the Tg is lower than 35° C., storage stability of the resultant toner is impaired in high temperature high humidity environments, hence solidification or aggregation occurs, as well as causing a problem, such as low charge due to surface changes. When the Tg is higher than 55° C., low temperature fixing ability of the resultant toner is impaired.

As for the measurement of the Tg of the toner for use in the present invention, for example, the measurement can be performed by means of a differential scanning calorimeter (e.g., DSC-6220R, manufactured by Seiko instruments Inc.). Specifically, a sample is heated from room temperature to 150° C. at a heating rate of 10° C./min, followed by leaving to stand at 150° C. for 10 minutes. Subsequently, the sample is cooled to room temperature, followed by leaving to stand for 10 minutes. The sample is again heated to 150° C. at a heating rate of 10° C./min. In the resultant DSC curve, the glass transition temperature can be determined from the base line at a temperature equal to or lower than the glass transition temperature and a curved line portion at a height which corresponds to ½ of the distance from the base line at a temperature equal to or lower than the glass transition temperature to the base line at a temperature equal to or higher than the glass transition temperature.

In order to realize low temperature fixing ability of a toner, it is necessary to make viscosity and glass transition temperature Tg of a binder resin low. However, it is difficult to attain storage stability (heat resistant storage stability) of a toner, if thermal properties, associated with the properties of the binder resin, become low influenced by a moisture in a high temperature high humidity environment.

In the present invention, therefore, a moisture-content change rate before and after leaving the toner extract for 3 days in the environment of 40° C. and 70% RH is 0.5% or less. When the moisture-content change rate is greater than 0.5%, thermal properties of the resultant toner is low, and therefore storage stability of the toner is poor, and there is a large change on surfaces of the toner particles. The moisture-content change rate is preferably in a range of from 0.1% through 0.5%.

A polyester resin is often used as a binder resin, as the polyester resin is effective for low temperature fixing, and has high affinity to paper. In this case, the high affinity to paper is attained with high polarity, which makes the toner vulnerable to a humidity. To improve hydrophobicity of the toner, on the other hand, means to lower the polarity. The low polarity reduces affinity to paper, and weakens an effect of low temperature fixing ability. Therefore, it is important to specifically define the moisture-content change rate as described above.

In the present invention, a moisture content of the toner extract is measured in accordance with a method specified in JIS K7251 (2002). A specific example of the measuring method is as follows. The toner extract obtained by drying in the aforementioned manner is ground by a mortar. The particle diameter of the ground product is adjusted to 150 μm using a 100-mesh, and the resultant is dried by a vacuum dryer for 4 hours at 40° C. Thereafter, the dried product is left to stand for 3 days in the environment of 40° C. and 70% RH. A moisture-content change rate can be calculated from weights before and after the storage. The moisture-content change rate can be determined with the following formula.

Moisture-content change rate (%)=(weight after leaving to stand−weight before leaving to stand)/weight before leaving to stand×100

Moreover, a digital precision balance (ER-180A, manufactured by A&D Company, Limited), the minimum display of which is 0.1 mg, can be used for the measurement of the weight. In the present invention, the moisture-content change rate is set 0.5% or less. In the case where a polyester resin is used, for example, it is assumed that the moisture-content change rate of 0% cannot be achieved practically. The value 0% in the present invention means a value of 0.04% or less as a matter of measuring accuracy.

In the present invention, it is important that the specific surface area change rate of the toner is a certain value in a high temperature high humidity environment. In the present invention, the specific surface area change rate of the toner before and after leaving the toner to stand for 3 days in the environment of 40° C. and 70% RH is a range of from 15% through 50%. The specific surface area change rate can be determined with the following formula.

Toner specific surface area change rate (%)=(BET specific surface area before storage−BET specific surface area after storage)/BET specific surface area before storage×100

When the specific surface area change rate is less than 15%, an affinity between the binder resin and paper is poor to thereby impair low temperature fixing ability of the toner, even though charge stability of the toner against environments is excellent. When the specific surface area change rate of the toner is greater than 50%, the polyester resin is significantly change by humidity, to thereby significantly reduce charging ability of the toner.

In the present invention, the toner preferably has a difference of 30 or less between a maximum value and a minimum value among peak intensities in a range of a molecular weight M±300, where the molecular weight M is an arbitrary molecular weight selected from a range of from 300 through 5,000 in a molecular weight distribution of THF-soluble components in the toner as measured by GPC. The peak intensities are defined as relative values assuming a maximum peak value in molecular weights of 20,000 or less is 100, in a molecular weight distribution curve taking an intensity as a vertical axis and a molecular weight as a horizontal axis as measured by GPC.

When the aforementioned difference is greater than 30, an effect of hydrophobicity is not exhibited, and therefore the resultant toner may be easily influenced from a high temperature high humidity environment. Moreover, the weight average molecular weight (Mw) as determined by the molecular weight distribution is preferably in a range of from 300 through 5,000. When the weight average molecular weight (Mw) is smaller than 300, the resultant toner is impaired in storage stability in high temperature high humidity environments, hence solidification or aggregation may occur, as well as causing a problem, such as low charge due to surface changes. When the weight average molecular weight (Mw) is greater than 5,000, low temperature fixing ability of the resultant toner may be impaired.

The aforementioned difference or weight average molecular weight (Mw) can be controlled by a monomer ratio, acid value, or hydroxyl value of a binder resin, such as a polyester resin. Moreover, a resin of a low hydroxyl value is preferably used in the present invention. Examples of a method for attaining the resin of a low hydroxyl value include a method containing blocking a polar group present at a terminal of a polyester polymer and introducing a monofunctional monomer to the polyester.

Moreover, the aforementioned control method is not particularly limited. Examples thereof include: a method for substituting a hydrophilic group at a terminal of a binder resin molecule with a lipophilic group; and a method for accelerating reaction conditions of a resin synthesis. The method for substituting a hydrophilic group at a terminal of a binder resin molecule with a lipophilic group is not particularly limited, and examples thereof include a method for substituting a terminal hydroxyl group with phenoxyacetic acid, or benzoic acid. Moreover, the method for accelerating reaction conditions of a resin synthesis is not particularly limited, and examples thereof include a method containing a reaction is performed for a long period at high temperature, followed by reducing the pressure to remove a monomer.

A molecular weight distribution of THF-soluble components in the toner as measured by GPC is determined as follows.

Gel permeation chromatography (GPC) measuring device: GPC-8220GPC (manufactured by Tosoh Corporation)

Column: TSK-GEL SUPER HZ2000, TSK-GEL SUPER HZ2500, and TSK-GEL SUPER HZ3000

Temperature: 40° C.

Solvent: tetrahydrofuran (THF)

Flow rate: 0.35 mL/min

Sample: THF sample solution having a concentration adjusted to 0.15% by mass

Pretreatment of sample: a toner is dissolved in THF (containing a stabilizer, manufactured by Wako Pure Chemical Industries, Ltd.) at 0.15% by mass, followed by filtering through a 0.45 μm filter. The resultant filtrate is used as the sample.

The measurement can be performed by injecting 10 μL through 200 μL of the THF sample solution. As for the measurement of the weight average molecular weight (Mw), a molecular weight distribution of the sample is calculated from the relationship between the number of counts and the logarithmic value of the calibration curve prepared from a several monodisperse polystyrene standard samples.

As for the polystyrene standard samples for preparing the calibration curve, for example, TSK standard polystyrene having molecular weights of 37,200, 6,200, 2,500, and 589 (manufactured by Tosoh Corporation), standard polystyrene having molecular weights of 28,400, 20,298, 10,900, 4,782, 1,689, and 1,309 (manufactured by SHOWA DENKO K.K.), and toluene can be used. As for the detector, a refractive index (RI) detector is used.

For the GPC measurement results, a molecular weight distribution curve is plotted by taking an intensity as a vertical axis and a molecular weight as a horizontal axis, and peak intensities throughout the molecular weight distribution curve are corrected assuming the maximum peak value in molecular weights of 20,000 or less is 100. The difference between the maximum value and the minimum value among the peak intensities is calculated by subtracting the minimum value from the maximum value in a range of an arbitrary molecular weight M±300 in the obtained molecular weight distribution curve.

Figure 6:
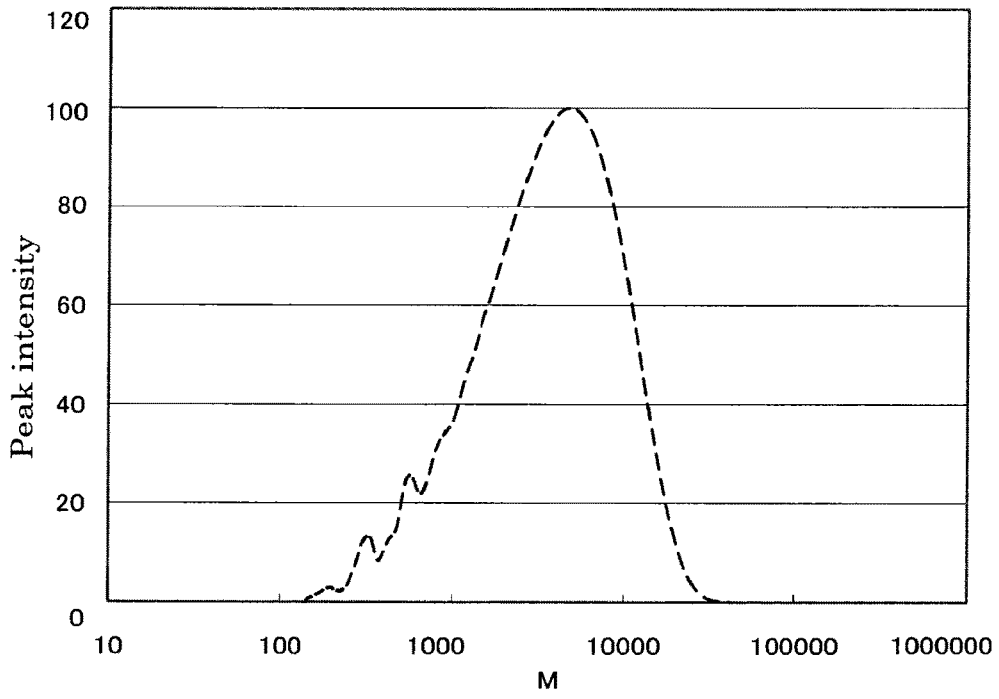
FIG. 6 is a schematic explanatory view illustrating one example of the GPC measurement of the toner of the present invention.
Figure 7:
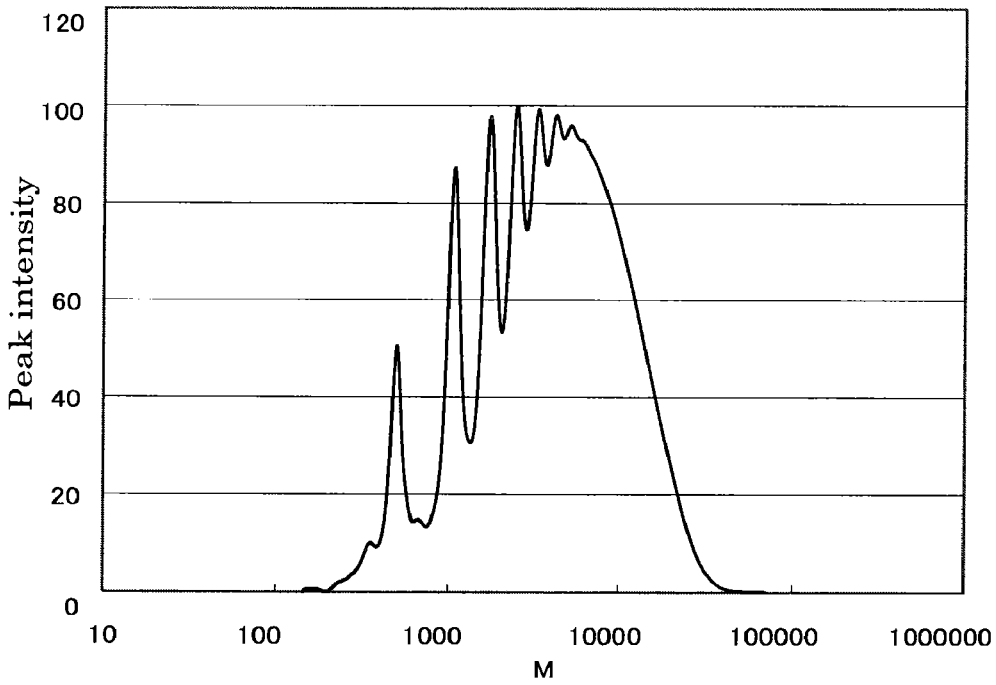
FIG. 7 is a schematic explanatory view illustrating one example of the GPC measurement of a conventional toner.

Selection of a column is important in the GPC measurement of THF-soluble components in a toner according to the present invention. The result is presented in FIG. 6 as the above described column was used to measure "a toner having a difference of 30 or less between the maximum value and the minimum value among peak intensities defined below (the definition is omitted) in a range of Molecular weight M±300 where Molecular weight M is a molecular weight selected from a range of from 300 through 5,000 in a molecular weight distribution of tetrahydrofuran (THF)-soluble components in the toner as measured by GPC" (Toner A). Meanwhile, the result from a conventional toner that is outside the scope of the present invention (Toner B) is presented in FIG. 7.

Figure 8:
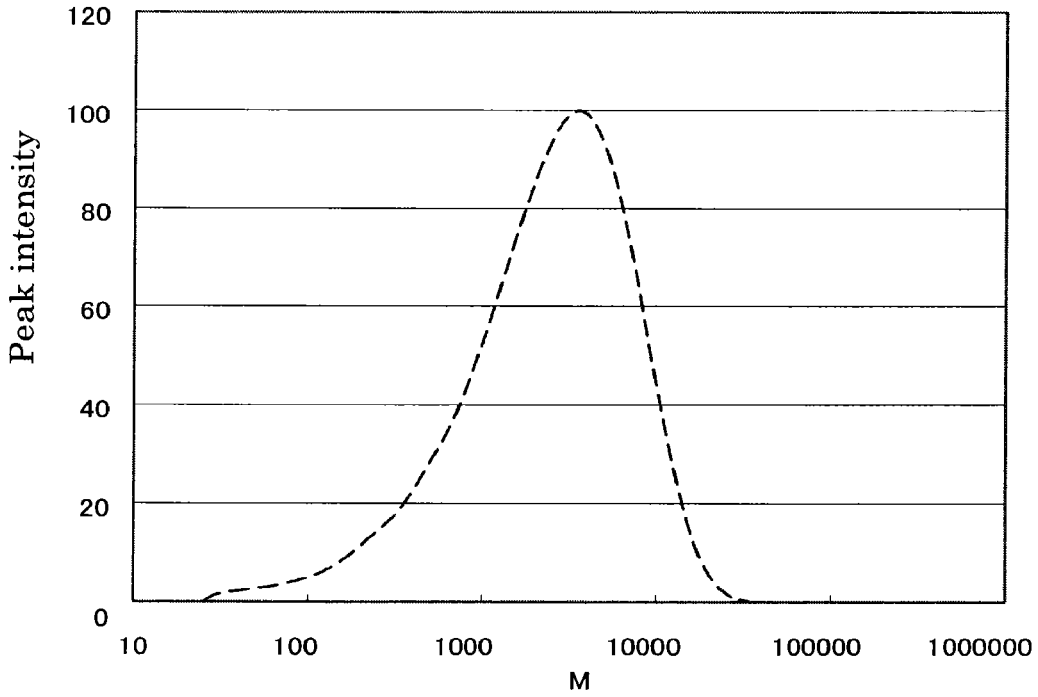
FIG. 8 is a schematic explanatory view illustrating another example of the GPC measurement of the toner of the present invention.
Figure 9:
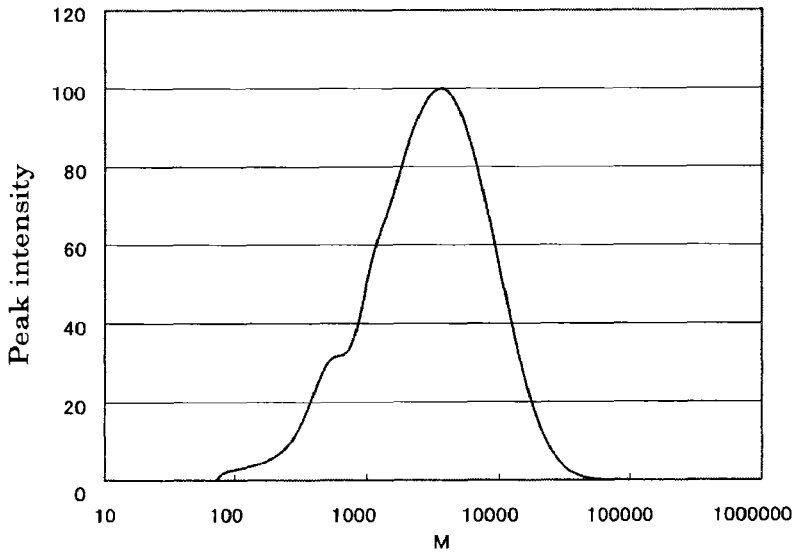
FIG. 9 is a schematic explanatory view illustrating another example of the GPC measurement of a conventional toner.

On the other hand, the results are presented in FIGS. 8 and 9 as three "TSK-GEL SUPER HZM-H" columns connected in series were used for the measurement instead of the above described "Column: TSK-GEL SUPER HZ2000, TSK-GEL SUPER HZ2500, and TSK-GEL SUPER HZ3000" (manufactured by Tosoh Corporation). FIG. 8 represents the result from Toner A, and FIG. 9 represents the result from Toner B. In the case of using the column according to the present invention, difference was not found between the Toner A and the conventional Toner B. Thus, selection of a column is important.

In the case where the binder resin contains a polyester resin in the present invention, an endothermic peak for first heating is preferably present in a range of from 40° C. through 70° C., and an endothermic peak for second heating is preferably present in a range of from 20° C. through 50° C. as measured by differential scanning calorimetry (DSC) of the toner. The aforementioned endothermic peaks suggest that both crystalline sites and amorphous sites are present in the polyester resin. When the aforementioned relationship is not satisfied, storage stability and low temperature fixing ability of the resultant toner may be adversely affected.

The toner of the present invention is preferably obtained by dissolving and/or dispersing, in an organic solvent, a binder resin precursor including at least a modified polyester resin to prepare an oil phase, dispersing the oil phase in an aqueous medium, in which a particle dispersant has been added, to obtain an O/W dispersion liquid (emulsified dispersion liquid), and removing the organic solvent from the O/W dispersion liquid. Note that, the oil phase may contain a polyester resin, a colorant, and a release agent. Specifically, the oil phase is obtained by dissolving and/or dispersing, in an organic solvent, toner materials including a polyester resin, a colorant, and a release agent.

The toner materials preferably include a crystalline polyester resin, a binder resin precursor composed of a modified polyester resin, and other binder resin components. At the time when the O/W dispersion liquid (emulsified dispersion liquid) is prepared, the oil phase is preferably dispersed in an aqueous medium, in which a particle dispersant is present, after dissolving a compound, which induces an elongation or cross-linking reaction with the binder resin precursor, in the oil phase. Moreover, it is preferred that the binder resin component be allowed to react through a cross-linking reaction and/or an elongation reaction in the emulsified dispersion liquid. The particle dispersant is a resin particle dispersant. The resin for use is appropriately selected from resins known in the art depending on the intended purpose without any limitation, provided that it is a resin capable of forming aqueous dispersion elements in an aqueous medium.

The resin for the resin particles may be a thermoplastic resin or a thermoset rein. As for the resin, for example, a vinyl resin, a polyurethane resin, an epoxy resin, a polyester resin, a polyamide resin, a polyimide resin, a silicon resin, a phenol resin, a melamine resin, a urea resin, an aniline resin, an ionomer resin, or a polycarbonate resin can be used. These resins may be used alone or in combination. Among them, the resin particles are preferably formed at least one resin selected from the group consisting of a vinyl resin, a polyurethane resin, an epoxy resin, and a polyester resin, as an aqueous dispersion liquid of fine spherical resin particles can be easily attained. Note that, the vinyl resin is a polymer obtained by homopolymerizing or copolymerizing a vinyl monomer. Examples of the vinyl resin include a styrene-(meth)acrylate resin, a styrene-butadiene copolymer, a (meth)acrylic acid-acrylate polymer, a styrene-acrylonitrile copolymer, a styrene-maleic anhydride copolymer, and a styrene-(meth)acrylic acid copolymer.

The weight average particle diameter (Dw), the volume average particle diameter (Dv), and the number average particle diameter (Dn) of the toner can be determined by measuring by means of a particle size analyzer (Multisizer III, manufactured by Beckman Coulter Inc.) with an aperture diameter of 100 μm, and analyzing with an analysis software (Beckman Coulter Multisizer 3 Version 3.51).

A specific example of the measurement is as follows. A 10% by mass surfactant (alkyl benzene sulfonate, NEOGEN SC-A, manufactured by DAI-ICHI KOGYO SEIYAKU CO., LTD.) (0.5 mL) is added to a 100 mL-glass beaker, and the toner (0.5 g) was added to the beaker. Then, the mixture is stirred by a micro-spatula, followed by adding 80 mL of ion-exchanged water. The obtained dispersion liquid is subjected to a dispersion treatment for 10 minutes by means of an ultrasonic wave disperser (W-113MK-II, manufactured by HONDA ELECTRONICS CO., LTD.).

The dispersion liquid is measured by the Multisizer III using ISOTON III (product of Beckman Coulter, Inc.) as a measurement solution. The toner sample dispersing liquid is added dropwise thereto so that a concentration of the toner indicated by the device is 8%±2%. In this measurement, it is important to adjust the concentration of the toner to 8%±2% in terms of measurement repeatability of the particle diameter. There is no accidental error so long as the concentration of the toner falls within the aforementioned range.

The ratio (Dw/Dn) of the weight average particle diameter (Dw) of the toner produced by the production method of the present invention to the number average particle diameter (Dn) of the toner is preferably 1.20 or less, more preferably a range of from 1.00 through 1.20.

When the ratio (Dw/Dn) of the weight average particle diameter to the number average particle diameter is less than 1.00, the resultant toner is fused on surfaces of carrier particles by stirring performed over a long time in a developing device, as the toner is used for a two-component developer. As a result, the charging ability of the carrier, and cleaning properties may be impaired. In case of a one-component developer, the resultant toner may be filed onto a developing roller, or the toner may be fused onto a member, such as a blade for thinning a toner layer.

When the ratio Dw/Dn is greater than 1.20, it is difficult to attain a high quality image of high resolution. When a toner in a developer is consumed and resupplied, a variation in particle diameters of the toner may be large.

When the ratio (Dw/Dn) of the weight average particle diameter of the toner to the number average particle diameter of the toner is a range of from 1.00 through 1.20, the resultant toner tends to have excellent storage stability, low temperature fixing ability, and hot offset resistance. Particularly when such the toner is used in a full-color photocopier, the resultant image has excellent glossiness.

In case of a two-component developer, there is a less variation in particle diameters of the toner particles in the developer even when the toner is consumed and resupplied over a long period, and excellent stable developing performance can be attained even when the developer is stirred in a developing device over a long period. In case of a one-component developer, there is a less variation in particle diameters of the toner particles in the developer even when the toner is consumed and resupplied, filming of the toner to a developing roller, or fusing of the toner to other members, such as a blade configured to thinning a toner layer can be prevented. Moreover, an excellent and stable developing performance is attained even when the toner is used (stirred) in a developing device over a long period, and a high quality image can be attained.

<Toner Raw Materials>

The toner of the present invention includes at least a binder resin, and may further contain a release agent and other ingredients, if necessary.

<<Binder Resin>>

The binder resin is appropriately selected depending on the intended purpose without any limitation, but the binder resin preferably includes a polyester resin. The polyester resin is specifically described hereinafter, but a rein other than the polyester resin can be also used as the binder resin.

The resin other than the polyester resin is appropriately selected depending on the intended purpose without any limitation, and examples of the resin include a styrene-acryl resin, a polyol resin, a vinyl resin, a polyurethane resin, an epoxy resin, a polyamide resin, a polyimide resin, a silicon-based resin, a phenol resin, a melamine resin, a urea resin, an aniline resin, an ionomer resin, and a polycarbonate resin. These resins may be used alone or in combination.

—Unmodified Polyester Resin—

In the present invention, an amorphous unmodified polyester resin is preferably used as the binder resin component.

Examples of the alcohol component used for the unmodified polyester resin include divalent alcohol (clion. Specific examples of the alcohol component include: C2-C36 alkylene glycol (e.g., ethylene glycol, 1,2-propylene glycol, 1,3-propylene glycol, 1,4-butylene glycol, and 1,6-hexanediol); C4-C36 alkylene ether glycol (e.g., diethylene glycol, triethylene glycol, dipropylene glycol, polyethylene glycol, polypropylene glycol, and polybutylene glycol); C6-C36 alicyclic diol (e.g., 1,4-cyclohexane dimethanol, and hydrogenated bisphenol A); C2-C4 alkylene oxide [e.g., ethylene oxide (abbreviated as EO hereinafter), propylene oxide (abbreviated as PO hereinafter), and butylene oxide (abbreviated as BO hereinafter)] adduct (the number of moles added: a range of from 1 through 30) of the above-listed alicyclic diol; and C2-C4 alkylene oxide (e.g., EO, PO, and BO) adduct (the number of moles added: a range of from 2 through 30) of bisphenol (e.g., bisphenol A, bisphenol F, and bisphenol S).

Moreover, a trivalent or higher (trivalent to octavalent or higher) alcohol component may be added in addition to the diol. Specific examples thereof include: C3-C36 trivalent to octavalent or higher aliphatic polyvalent alcohol (e.g., alkane polyol, and intramolecular or intermolecular dehydrate thereof), such as glycerin, triethylolethane, trimethylolpropane, pentaerythritol, sorbitol, sorbitan, polyglycerin, and di pentaerythritol; sugars and derivatives thereof, such as sucrose, and methyl glucoside); C2-C4 alkylene oxide (e.g., EO, PO, and BO) adducts (the number of moles added: a range of from 1 through 30) of the foregoing aliphatic polyvalent alcohol; C2-C4 alkylene oxide (e.g., EO, PO, and BO) adducts (the number of moles added: a range of from 2 through 30) of trisphenol (e.g., trisphenol PA); and C2-C4 alkylene oxide (e.g., EO, PO, and BO) adducts (the number of moles added: a range of from 2 through 30) of a novolak resin (e.g., phenol novolak, and cresol novolak, the average degree of polymerization: a range of from 3 through 60).

Examples of the carboxylic acid component used for the unmodified polyester resin include divalent carboxylic acid (dicarboxylic acid). Specific examples thereof include: C4-C36 alkane dicarboxylic acid (e.g., succinic acid, adipic acid, and sebacic acid) and alkenyl succinic acid (e.g., dodecenyl succinic acid); C4-C36 alicyclic dicarboxylic acid (e.g., dimer acid, such as dimerized linoleic acid); C4-C36 alkene dicarboxylic acid (e.g., maleic acid, fumaric acid, citraconic acid, and mesaconic acid); and C8-C36 aromatic dicarboxylic acid (e.g., phthalic acid, isophthalic acid, terephthalic acid, derivatives thereof, and naphthalene dicarboxylic acid).

Among them, preferred are C4-C20 alkene dicarboxylic acid, and C8-C20 aromatic dicarboxylic acid. Note that, acid anhydride or lower (C1-C4) alkyl ester (e.g., methyl ester, ethyl ester, and isopropyl ester) of the above-listed carboxylic acids may be used as polycarboxylic acid.

Moreover, a trivalent or higher (trivalent to hexavalent or higher) carboxylic acid component may be added in addition to the divalent carboxylic acid. Specific examples thereof include: C9-C20 aromatic polycarboxylic acid (e.g., trimellitic acid, and pyromellitic acid); and vinyl polymers [number average molecular weight (abbreviated as Mn hereinafter, as measured by gel permeation chromatography (GPC)); a range of from 450 through 10,000] of unsaturated carboxylic acid (e.g., a styrene/maleic acid copolymer, styrene/acrylic acid copolymer, α-olefin/maleic acid copolymer, and styrene/fumaric acid copolymer). Among them, C9-C20 aromatic polycarboxylic acid is preferable, and trimellitic acid and pyromellitic acid are particularly preferable. Note that, acid anhydride or lower (C1-C4) alkyl ester (e.g., methyl ester, ethyl ester, and isopropyl ester) of the above-listed polycarboxylic acids may be used as trivalent or higher polycarboxylic acid.

In the present invention, it is preferred that the alcohol component and the carboxylic acid component be allowed to react with the predetermined OH/COOH ratio, followed by adding the predetermined amount of benzoic acid to carry out a further reaction. The ratio OH/COOH and the amount of benzoic acid are not particularly limited, as the ratio and the amount can be appropriately changed depending on types or amounts of the alcohol component and carboxylic acid component for use.

The acid value of the unmodified polyester resin is preferably a range of from 1 KOHmg/g through 50 KOHmg/g, more preferably a range of from 5 KOHmg/g through 30 KOHmg/g. When the acid value of the unmodified polyester resin is 1 KOHmg/g or greater, the resultant toner tends to be negatively charged, to improve affinity to paper, when fixed on the paper. As a result, low temperature fixing ability of the toner is improved. When the acid value is greater than 50 KOHmg/g, however, charging stability, especially charging stability against fluctuations of environmental conditions, may be low. In the present invention, the acid value of the unmodified polyester resin is preferably a range of from 1 KOHmg/g through 50 KOHmg/g.

The hydroxyl value of the unmodified polyester resin is preferably a range of from 10 KOHmg/g through 30 KOHmg/g. The hydroxyl value is largely related to a moisture-content change rate. When the hydroxyl value is within the aforementioned range, a modification of the polyester resin due to a humidity can be prevented, a reduction in thermal properties is suppressed, and therefore a change in a specific surface area of the toner in high temperature high humidity environment can be prevented. When the hydroxyl value is greater than 30 KOHmg/g, the resultant toner is easily influenced by a humidity, and a modification of the polyester resin cannot be prevented. The modification of the polyester resin causes a change in the specific surface area of the toner. As a result, charge of the toner is low. When the hydroxyl value is less than 10 KOHmg/g, an effect of negative charging is not sufficiently attained, and a problem occurs in terms of production stability. Accordingly, the hydroxyl value is more preferably a range of from 10 KOHmg/g through 20 KOHmg/g.

Examples of a method for attaining a resin of a low hydroxyl value, which is preferably used in the present invention, include a method containing blocking a polar group present at a terminal of a polyester polymer and introducing a monofunctional monomer to the polyester.

The hydroxyl value can be measured by a method in accordance with JIS K0070-1966.

Specifically, 0.5 g of a sample is measured in a 100 mL measuring flask. To the flask, 5 mL of an acetylation reagent. Next, the mixture is heated for 1 hour to 2 hours in a hot water bath of 100° C.±5° C., and then the flask is taken out from the hot water bath and left to cool. Next, to the resultant, water is added, and the resultant mixture is shaken to decompose acetic anhydride. In order to completely decompose acetic anhydride, the flask is again heated for 10 minutes or longer in a hot water bath and left to cool, followed by sufficiently washing a wall of the flask with an organic solvent.

Further, the hydroxyl value is measured at 23° C. by means of a potentiometric automatic titrator (DL-53 Titrator, manufactured by Mettler-Toledo K.K.) and an electrode DG113-SC (product of Mettler-Toledo K.K.). The measurements are analyzed with an analysis software LabX Light Version 1.00.000. Note that, a mixed solvent of 120 mL of toluene and 30 mL of ethanol is used for calibration of the device.

The measuring conditions are as follows.

Stir
  Speed [%] 25
  Time [s] 15
EQP Titration
  Titrant/Sensor
  Titrant $CH_3Ona$
  Concentration [mol/L] 0.1
  Sensor DG115
  Unit of measurement mV
  Predispensing to Volume
  Volume [mL] 1.0
  Wait time [s] 0
  Titrant Addition Dynamic
  dE(set) [mV] 8.0
  dV(min) [mL] 0.03
  dV(max) [mL] 0.5
  Measure Mode Equilibrium Controlled
  dE, [mV] 0.5
  dt [s] 1.0
  t(min) [s] 2.0
  t(max) [s] 20.0
  Recognition
  Threshold 100.0
  Steepest jump only No
  Range No
  Tendency None
  Termination
  at maximum volume [mL] 10.0
  at potential No
  at slope No
  after number EQPs Yes
    n=1
  comb. termination conditions No
  Evaluation
  Procedure Standard
  Potential 1 No
  Potential 2 No
  Stop for reevaluation No The glass transition temperature Tg of the binder resin is preferably in a range of from 35° C. through 55° C. When the Tg is lower than 35° C., storage stability of the resultant toner is poor in a high-temperature high-humidity environment, and therefore solidification or aggregation of the toner particles occurs, or the charging ability of the toner is low due to changes caused in surfaces of the toner particles. When the Tg is higher than 55° C., low temperature fixing ability of the resultant toner is impaired.

—Crystalline Polyester Resin—

In order to achieve low temperature fixing ability of the toner, the binder resin may contain a crystalline polyester resin. The crystalline polyester resin is appropriately selected depending on the intended purpose without any limitation. Suitable examples of the crystalline polyester resin include one represented by the following general formula (1).

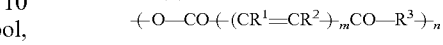

$$\text{—}(\text{O—CO—}(\text{CR}^1\text{=CR}^2)_m\text{CO—R}^3)_n \qquad \text{General Formula (1)}$$

In the general formula (1), m is an integer of 1 or greater, preferably in a range of from 1 through 3; n represents a degree of polymerization, and is an integer of 1 or greater; and $R^1$ and $R^2$ may be identical or different, and are each a hydrogen atom or a hydrocarbon group.

The hydrocarbon group is appropriately selected depending on the intended purpose without any limitation, and examples of the hydrocarbon group include an alkyl group, an alkenyl group, and an aryl group. These hydrocarbon groups may be substituted with a substituent.

The alkyl group is preferably a C1-C10 alkyl group. Examples of the alkyl group include a methyl group, an ethyl group, a n-propyl group, an isopropyl group, a n-butyl group, an isobutyl group, a sec-butyl group, a n-hexyl group, an isohexyl group, a n-heptyl group, a n-octyl group, an isooctyl group, a n-decyl group, and an isodecyl group.

The alkenyl group is preferably a C2-C10 alkenyl group. Examples of the alkenyl group include a vinyl group, an allyl group, a propenyl group, an isopropenyl group, a butenyl group, a hexenyl group, and an octenyl group.

The aryl group is preferably a C6-C24 aryl group. Examples of the aryl group include a phenyl group, a tolyl group, a xylyl group, a cumenyl group, a styryl group, a mesityl group, a cinnamyl group, a phenethyl group, and a benzhydryl group.

In the general formula (1), $R^3$ is a bivalent hydrocarbon group, preferably a C1-C10 hydrocarbon group. Examples thereof include an alkylene group represented by $\text{—}(CH_2)_p\text{—}$ (providing that p is in a range of from 1 through 10).

Among them, particularly preferred are $\text{—}CH_2\text{—}$, $\text{—}CH_2CH_2\text{—}$, $\text{—}CH_2CH_2CH_2\text{—}$, and $\text{—}CH_2C(CH_3)H\text{—}$.

The crystallinity, and molecular structure of the crystalline polyester resin can be confirmed by NMR spectroscopy, differential scanning calorimetry (DSC), X-ray diffraction spectroscopy, GC/MS, LC/MS, or infrared (IR) absorption spectroscopy.

For example, the crystalline polyester resin preferably has an absorption based on δCH (out plane bending) of olefin at 965±10 $cm^{-1}$ and 990±10 $cm^{-1}$ in the infrared (IR) absorption spectrum of the crystalline polyester resin. In this case, the resin exhibiting the aforementioned absorption is evaluated as crystalline.

The molecular weight distribution of the crystalline polyester resin is appropriately selected depending on the intended purpose without any limitation. The molecular weight distribution is preferably sharp. Moreover, the molecular weight distribution is preferably a low molecular weight, as the resultant toner using such the crystalline polyester resin has excellent low temperature fixing ability.

Moreover, it is preferred that a peak position be within a range of from 3.5 through 4.0, and a half value width of the peak be 1.5 or less in a molecular weight distribution diagram as measured by gel permeation chromatography (GPC) of ortho-dichlorobenzene-soluble components, where a horizontal axis is for log (M), and a vertical axis for % by mass.

The weight average molecular weight (Mw) of the crystalline polyester resin is appropriately selected depending on the intended purpose without any limitation. For example, the Mw of the crystalline polyester resin is preferably a range of from 1,000 through 30,000, more preferably a range of from 1,200 through 20,000.

When the weight average molecular weight is less than 1,000, low temperature fixing ability of the resultant toner may be poor. When the weight average molecular weight is greater than 30,000, sharp-melt properties of the resultant toner may be poor.

The number average molecular weight (Mn) of the crystalline polyester resin is appropriately selected depending on the intended purpose without any limitation. For example, the Mn of the crystalline polyester resin is preferably a range of from 500 through 6,000, more preferably a range of from 700 through 5,500.

When the number average molecular weight is less than 500, low temperature fixing ability of the resultant toner may be poor. When the number average molecular weight is greater than 6,000, sharp-melt properties of the resultant toner may be poor.

The molecular weight distribution (Mw/Mn) represented by a ratio of the weight average molecular weight (Mw) to the number average molecular weight (Mn) is appropriately selected depending on the intended purpose without any limitation. For example, the molecular weight distribution (Mw/Mn) is preferably in a range of from 2 through 8.

When the molecular weight distribution (Mw/Mn) is less than 2, it is difficult to produce, and a cost for the production may be high. When the molecular weight distribution (Mw/Mn) is greater than 8, sharp-melt properties of the toner may be poor.

The melting temperature (Tm) (may be referred to as "F½ temperature") of the crystalline polyester resin is appropriately selected depending on the intended purpose without any limitation. The melting temperature (Tm) can be, for example, determined with an DSC endothermic peak temperature on a DSC curve obtained by differential scanning calorimetry (DSC), which is preferably in a range of from 50° C. through 150° C., more preferably a range of from 60° C. through 130° C.

When the melting temperature (Tm) is lower than 50° C., heat resistant storage stability of a toner is poor, and thus blocking tends to occur at an internal temperature of a developing device. When the melting temperature (Tm) is higher than 150° C., the minimum fixing temperature of the toner becomes high, and thus low temperature fixing ability cannot be achieved.

The acid value of the crystalline polyester resin is appropriately selected depending on the intended purpose without any limitation. For example, the acid value of the crystalline polyester resin is preferably 5 mgKOH/g or greater, more preferably 10 mgKOH/g or greater. Note that, the acid value of the crystalline polyester resin is preferably 45 mgKOH/g or less in view of an improvement in hot offset resistance.

When the acid value is less than 5 mgKOH/g, an affinity between paper and the resin cannot be attained, and the intended low temperature fixing ability of the toner cannot be achieved.

For example, the acid value of the crystalline polyester resin can be measured by dissolving the crystalline polyester resin in 1,1,1,3,3,3-hexafluoro-2-propanol, and subjecting the resultant solution to titration.

The hydroxyl value of the crystalline polyester resin is appropriately selected depending on the intended purpose without any limitation. For example, the hydroxyl value of the crystalline polyester resin is preferably in a range of from 0 mgKOH/g through 50 mgKOH/g, more preferably a range of from 5 mgKOH/g through 50 mgKOH/g.

When the hydroxyl value is greater than 50 mgKOH/g, the intended low temperature fixing ability of the toner and excellent charging properties of the toner cannot be attained.

For example, the hydroxyl value of the crystalline polyester resin can be measured by dissolving the crystalline polyester resin in 1,1,1,3,3,3-hexafluoro-2-propanol, and subjecting the resultant solution to titration.

For example, the crystalline polyester resin can be synthesized by allowing an alcohol component and an acid component to react through a polycondensation reaction.

The alcohol component is appropriately selected depending on the intended purpose without any limitation. Suitable example of the alcohol component include a diol compound. As for the diol compound, for example, a C2-C8 diol compound is preferable, more preferably C2-C6 diol compound. Examples of the diol compound include 1,4-butanediol, ethylene glycol, 1,2-propylene glycol, 1,3-propylene glycol, 1,6-hexanediol, neopentyl glycol, 1,4-butenediol, 1,5-pentanediol, and derivatives thereof. Among them, preferred are 1,4-butanediol, and 1,6-hexanediol.

These diol compounds may be used alone or in combination.

An amount of the diol compound in the alcohol component is preferably 80 mol % or greater, more preferably in a range of from 85 mol % through 100 mol %. When the amount of the diol compound in the alcohol component is less than 80 mol %, production efficiency may be low.

The acid component is appropriately selected depending on the intended purpose without any limitation. Suitable examples of the acid component include carboxylic acid including a carbon double bond, a dicarboxylic acid compound, and a multivalent carboxylic acid compound. Among them, a dicarboxylic acid compound is preferable.

As for the dicarboxylic acid compound, for example, a C2-C8 dicarboxylic acid compound is preferable, and a C2-C6 dicarboxylic acid compound is more preferable. Examples of the dicarboxylic acid compound include oxalic acid, malonic acid, maleic acid, fumaric acid, citraconic acid, itaconic acid, glutaconic acid, succinic acid, adipic acid, anhydrides of the foregoing dicarboxylic acid compounds, and C1-C3 alkyl esters of the foregoing dicarboxylic acid compounds. Among them, fumaric acid is preferable. These dicarboxylic acid compounds may be used alone or in combination.

An amount of the dicarboxylic acid compound for use is preferably 80 mol % or greater, more preferably in a range of 85 mol % through 100 mol % in the acid component. When the amount of the dicarboxylic acid compound in the acid component is less than 80 mol %, production efficiency may be low.

Examples of the multivalent carboxylic acid compound include trimellitic acid, pyromellitic acid, anhydride of the foregoing acids, and C1-C3 alkyl esters of the foregoing acids.

The polycondensation reaction is appropriately selected depending on the intended purpose without any limitation. For example, the polycondensation reaction can be performed at a temperature in a range of from 120° C. through 230° C. in an inert gas atmosphere using an esterification catalyst, and a polymerization inhibitor.

When the polycondensation reaction is carried out, all monomers may be loaded at once for the purpose of improving a strength of a crystalline polyester resin to be obtained. Moreover, a divalent monomer may be reacted, followed by adding a trivalent or higher monomer is added to proceed a further reaction, for the purpose of reducing low molecular weight components. The pressure of the reaction system may be reduced at the latter stage of the polycondensation reaction for the purpose of accelerating the reaction. For the purpose of controlling crystallinity and a softening point of the crystalline polyester resin, a trivalent or higher polyvalent alcohol, such as glycerin, may be added as the alcohol component and trivalent or higher multivalent carboxylic acid, such as trimellitic anhydride, may be added as the acid component at the time of the polycondensation reaction, to thereby obtain non-linear polyester.

One example of a production method of the crystalline polyester resin is as follows.

For example, a 5 L four-necked flask equipped with a nitrogen-inlet tube, a condenser, a stirrer, and a thermocouple is charged with 1,4-butanediol, fumaric acid, trimellitic anhydride, and hydroquinone, and the resultant mixture is allowed to react for 5 hours at 160° C. Thereafter, the resultant is heated to 200° C., and is allowed to react for 1 hour. Subsequently, the resultant is allowed to react for 1 hour under the reduced pressure of 8.3 kPa, to thereby synthesize a crystalline polyester resin.

Note that, other than the unmodified polyester resin, a polyester resin modified with a chemical bond other than a urea bond, such as a polyester resin modified with a urethane bond, can be used in combination with the polyester resin.

In the case where the toner composition contains a modified polyester resin, such as a urea-modified polyester resin, the modified polyester resin can be produced by a one-shot process.

As one example, a production method of a urea-modified polyester resin is described.

First, polyol and polycarboxylic acid are heated at a temperature in a range from 150° C. through 280° C. in the presence of a catalyst, such as tetrabutoxytitanate, and dibutyl tin oxide, optionally with removing generated water under the reduced pressure, to thereby obtain a polyester resin containing a hydroxyl group. Subsequently, the polyester resin containing a hydroxyl group and polyisocyanate are allowed to react at 40° C. to 140° C., to thereby obtain polyester prepolymer containing an isocyanate group. Furthermore, the polyester prepolymer containing an isocyanate group and amine are allowed to react at a temperature in a range 0° C. through 140° C., to thereby obtain a urea-modified polyester resin.

The number average molecular weight of the urea-modified polyester resin is typically in a range of from 1,000 through 10,000, preferably a range of from 1,500 through 6,000.

In the case where the polyester resin containing a hydroxyl group and the polyisocyanate are allowed to react, or the polyester prepolymer containing an isocyanate group and the amine are allowed to react, a solvent can be optionally used.

Examples of the solvent include solvent inert to an isocyanate group, such as an aromatic solvent (e.g., toluene, and xylene), ketones (e.g., acetone, methyl ethyl ketone, and methyl isobutyl ketone), esters (e.g., ethyl acetate), amides (e.g., dimethyl formamide, and dimethyl acetoamide), and ethers (e.g., tetrahydrofuran).

In the case where an unmodified polyester resin is used in combination, a resin produced in the same manner as the polyester resin containing a hydroxyl group may be mixed with a solution obtained after a reaction for a urea-modified polyester resin.

In the present invention, a crystalline polyester resin, an unmodified polyester resin, a binder resin precursor, and an unmodified resin may be used in combination as a binder resin component contained in an oil phase. A binder resin other than the aforementioned resins may be further added. The binder resin component preferably contains a polyester resin, and preferably contains the polyester resin in the amount of 50% by mass or greater. When the amount of the polyester resin is less than 50% by mass, low temperature fixing ability of the resultant toner may be poor. It is particularly preferred that the entire binder resin component be composed of a polyester resin.

Examples of the binder resin component other than the polyester resin include: a polymer of styrene or styrene substituent, such as polystyrene, poly(p-chlorostyrene), and polyvinyl toluene; a styrene copolymer, such as a styrene-p-chlorostyrene copolymer, a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl-α-chloromethacrylate copolymer, a styrene-acrylonitrile copolymer, a styrene-methyl vinyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer; polymethyl methacrylate; polybutyl methacrylate; polyvinyl chloride; polyvinyl acetate; polyethylene; polypropylene; an epoxy resin; an epoxy polyol resin; a polyurethane resin; a polyamide resin; polyvinyl butyral; a polyacrylic acid resin; rosin; modified rosin; a terpene resin; an aliphatic or alicyclic hydrocarbon resin; an aromatic petroleum resin; chlorinated paraffin; and paraffin wax.

—Polymer Reactable with Active Hydrogen Group-Containing Compound—

The polymer reactable with the active hydrogen-group containing resin (referred as a "prepolymer" hereinafter) is appropriately selected from resins known in the art without any limitation, provided that the polymer contains at least a site reactive with the active hydrogen group-containing compound. Examples thereof include a polyol resin, a polyacryl resin, a polyester resin, an epoxy resin, and derivative resins of the foregoing resins Among them, the polyester resin is particularly preferable in view of high fluidity when melted, and transparency. These resins may be used alone or in combination.

The site in the prepolymer, which is reactable with the active hydrogen group-containing compound, is appropriately selected from substituents known in the art without any limitation. Examples of the site include an isocyanate group, an epoxy group, a carboxyl group, and an acid chloride group. These groups may be contained alone, or in combination. Among them, the isocyanate group is particularly preferable.

Among the prepolymers, a polyester resin containing a urea bond-generating group (RMPE) is particularly preferable, as a molecular weight of a high molecular component can be easily controlled, and excellent mold-releasing property and fixing ability can be secured even when the resultant toner is used in oil-less low temperature fixing, especially in an apparatus that does not contain a releasing oil coating system for a heating member for fixing.

Examples of the urea bond generating group include an isocyanate group. In the case where the urea bond generating group in the polyester resin containing a urea bond-generating group (RMPE) is the isocyanate group, the polyester resin containing a urea bond-generating group (RMPE) is particularly preferably an isocyanate group-containing polyester prepolymer (A).

The isocyanate group-containing polyester prepolymer (A) is appropriately selected depending on the intended purpose without any limitation. For example, the isocyanate group-containing polyester prepolymer (A) is a polycondensation product between polyol (PO) and polycarboxylic acid (PC), and can be obtained by reacting the active hydrogen group-containing polyester resin with polyisocyanate (PIC).

The polyol (PO) is appropriately selected depending on the intended purpose without any limitation, and examples of the polyol (PO) include diol (DIO), trivalent or higher polyol (TO), and a mixture of diol (DIO) and trivalent or higher polyol (TO). These may be used alone or in combination.

Among them, the diol (DIO) alone, and a mixture containing the diol (DIO) and a small amount of the trivalent or higher polyol (TO) are preferable.

Examples of the diol (DIO) include alkylene glycol, alkylene ether glycol, alicyclic diol, an alkylene oxide adduct of alicyclic diol, bisphenol, and an alkylene oxide adduct of bisphenol.

The alkylene glycol is preferably C2-C12 alkylene glycol, and examples thereof include ethylene glycol, 1,2-propylene glycol, 1,3-propylene glycol, 1,4-butanediol, and 1,6-hexanediol. Examples of the alkylene ether glycol include diethylene glycol, triethylene glycol, dipropylene glycol, polyethylene glycol, polypropylene glycol, and polytetramethylene ether glycol.

Examples of the alicyclic diol include 1,4-cyclohexane dimethanol, and hydrogenated bisphenol A. Examples of the alicyclic diol alkylene oxide adduct include an adduct obtained by adding alkylene oxide (e.g., ethylene oxide, propylene oxide, and butylene oxide) to alicyclic diol.

Examples of the bisphenol include bisphenol A, bisphenol F, and bisphenol S. Examples of the bisphenol alkylene oxide adduct include an adduct obtained by adding alkylene oxide (e.g., ethylene oxide, propylene oxide, butylene oxide) to bisphenol. Among them, C2-C12 alkylene glycol, and an alkylene oxide adduct of bisphenol are preferable, and an alkylene oxide adduct of bisphenol, and a mixture of an alkylene oxide adduct of bisphenol and C2-C12 alkylene glycol.

The trivalent or higher polyol (TO) is preferably trivalent to octavalent or higher polyol, and examples thereof include trivalent or higher polyvalent aliphatic alcohol, trivalent or higher polyphenol, and an alkylene oxide adduct of trivalent or higher polyphenol.

Examples of the trivalent or higher polyvalent aliphatic alcohol include glycerin, trimethylol ethane, trimethylol propane, pentaerythritol, and sorbitol.

Examples of the trivalent or higher polyphenol include trisphenol (e.g., trisphenol PA, manufactured by HONSHU CHEMICAL INDUSTRY CO., LTD.), phenol novolak, and cresol novolak.

Examples of the alkylene oxide adduct of trivalent or higher polyphenol include compounds obtained by adding an alkylene oxide (e.g., ethylene oxide, propylene oxide, and butylene oxide) to trivalent or higher polyphenol.

A blending mass ratio (DIO TO) between the diol (DIO) and the trivalent or higher polyol (TO) in the mixture of the diol (DIO) and the trivalent or higher polyol (TO) is preferably 100:0.01 through 10, more preferably 100:0.01 through 1.

The polycarboxylic acid (PC) is appropriately selected depending on the intended purpose without any limitation, and examples thereof include dicarboxylic acid (DIC), trivalent or higher polycarboxylic acid (TC), and a mixture containing dicarboxylic acid (DIC) and trivalent or higher polycarboxylic acid (TC). These may be used alone or in combination. Among them, preferred are dicarboxylic acid (DIC) alone, and a mixture containing DIC and a small amount of trivalent or higher polycarboxylic acid (TC).

Examples of the dicarboxylic acid (DIC) include alkylene dicarboxylic acid, alkenylene dicarboxylic acid, and aromatic dicarboxylic acid.

Examples of the alkylene dicarboxylic acid include succinic acid, adipic acid, and sebacic acid.

The alkenylene dicarboxylic acid is preferably C4-C20 alkenylene dicarboxylic acid, and examples thereof include maleic acid, and fumaric acid.

The aromatic dicarboxylic acid is preferably C8-C20 aromatic dicarboxylic acid, and examples thereof include phthalic acid, isophthalic acid, terephthalic acid, and naphthalene dicarboxylic acid.

Among them, preferred are C4-C20 alkenylene dicarboxylic acid, and C8-C20 aromatic dicarboxylic acid.

The trivalent or higher polycarboxylic acid (TC) is preferably trivalent to octavalent or higher polycarboxylic acid, and examples thereof include aromatic polycarboxylic acid.

The aromatic polycarboxylic acid preferably is preferably C9-C20 aromatic polycarboxylic acid. Examples of the aromatic polycarboxylic acid include trimellitic acid, and pyromellitic acid.

As for the polycarboxylic acid (PC), acid anhydride or lower alkyl ester of at least one selected from the group consisting of the dicarboxylic acid (DIC), the trivalent or higher polycarboxylic acid (TC), and a mixture of the dicarboxylic acid (DIC) and the trivalent or higher polycarboxylic acid may be used. Examples of the lower alkyl ester include methyl ester, ethyl ester, and isopropyl ester.

A blending mass ratio (DIC TC) between the dicarboxylic acid (DIC) and the trivalent or higher polycarboxylic acid (TC) in the mixture of the dicarboxylic acid (DIC) and the trivalent or higher polycarboxylic acid (TC) is preferably in a range of from 100:0.01 through 100:10, more preferably a range of from 100:0.01 through 100:1.

A blending ratio of the polyol (PO) and the polycarboxylic acid (PC) for a polycondensation reaction is appropriately selected depending on the intended purpose without any limitation. An equivalent ratio ([OH]/[COOH]) of hydroxyl groups [OH] in the polyol (PO) to carboxyl groups [COOH] in the polycarboxylic acid (PC) is typically in a range of from 2/1 through 1/1, preferably a range of from 1.5/1 through 1/1, and more preferably a range of from 1.3/1 through 1.02/1.

An amount of the polyol (PO) in the isocyanate group-containing polyester prepolymer (A) is appropriately selected depending on the intended purpose without any limitation. For example, the amount thereof is preferably in a range of from 0.5% by mass through 40% by mass, more preferably a range of from 1% by mass through 30% by mass, and even more preferably a range of from 2% by mass through 20% by mass. When the amount of the polyol (PO) is less than 0.5% by mass, hot offset resistance of the resultant toner is poor, and it may be difficult to achieve both heat resistant storage stability and low temperature fixing ability of the toner. When the amount thereof is greater than 40% by mass, low temperature fixing ability of the resultant toner may be poor.

The polyisocyanate (PIC) is appropriately selected depending on the intended purpose without any limitation, and example thereof include aliphatic polyisocyanate, alicyclic polyisocyanate, aromatic diisocyanate, aromatic aliphatic diisocyanate, isocyanurate, phenol derivatives of the foregoing polyisocyanates, and compounds obtained by blocking the foregoing polyisocyanates with oxime, or caprolactam.

Examples of the aliphatic polyisocyanate include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate, and tetramethylhexane diisocyanate.

Examples of the alicyclic polyisocyanate include isophorone diisocyanate, and cyclohexylmethane diisocyanate.

Examples of the aromatic diisocyanate include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate.

Examples of the aromatic aliphatic diisocyanate include α,α,α',α'-tetramethylxylene diisocyanate.

Examples of the isocyanurate include tris(isocyanatoalkyl)isocyanurate, and tri(isocyanatocycloalkyl)isocyanurate. These may be used alone or in combination.

A blending ratio, when the polyisocyanate (PIC) and the active hydrogen group-containing polyester resin (e.g., a hydroxyl group-containing polyester resin) are allowed to react, is preferably as follows. Specifically, a blending equivalent ratio ([NCO]/[OH]) of isocyanate groups [NCO] in the polyisocyanate (PIC) to hydroxyl groups [OH] in the active hydrogen group-containing polyester resin is preferably in a range of from 5/1 through 1/1, more preferably a range of from 4/1 through 1.2/1, and even more preferably a range of from 3/1 through 1.5/1. When the equivalent ratio [NCO]/[OH] is greater than 5, low temperature fixing ability of the resultant toner may be poor. When the equivalent ratio [NCO]/[OH] is less than 1, offset resistance of the resultant toner may be poor.

An amount of the polyisocyanate (PIC) in the isocyanate group-containing polyester prepolymer (A) is appropriately selected depending on the intended purpose without any limitation. For example, the amount of the polyisocyanate (PIC) is preferably in a range of from 0.5% by mass through 40% by mass, more preferably a range of from 1% by mass through 30% by mass, and even more preferably a range of from 2% by mass through 20% by mass. When the amount thereof is less than 0.5% by mass, hot offset resistance of the resultant toner is poor, and therefore it may be difficult to achieve both heat resistant storage stability and low temperature fixing ability of the toner. When the amount thereof is greater than 40% by mass, low temperature fixing ability of the resultant toner may be poor.

The average number of isocyanate groups contained per molecule of the isocyanate group-containing polyester prepolymer (A) is preferably 1 or greater, more preferably in a range of from 1.2 through 5, and even more preferably a range of from 1.5 through 4. When the average number of isocyanate groups is less than 1, a molecular weight of the polyester resin modified with a urea generating group (RMPE) is low, and thus thus the resultant toner may be deteriorated in hot offset resistance.

As for the weight average molecular weight (Mw) of the polymer reactable with the active hydrogen group-containing compound, the weight average molecular weight (Mw) thereof determined with a molecular weight distribution obtained by gel permeation chromatography (GPC) of the tetrahydrofuran (THF)-soluble component is preferably in a range of from 3,000 through 40,000, more preferably a range of from 4,000 through 30,000. When the weight average molecular weight (Mw) thereof is smaller than 3,000, heat resistant storage stability of the resultant toner may be poor. When the weight average molecular weight (Mw) thereof is greater than 40,000, low temperature fixing ability of the resultant toner may be poor.

<<Release Agent>>

The release agent is appropriately selected depending on the intended purpose without any limitation, but the release agent is preferably a release agent of a low melting point that is in a range of from 50° C. through 120° C. As the release agent of a low melting point is dispersed with the resin, the release agent effectively functions at an interface between a fixing roller and the toner. As a result, excellent hot offset resistance can be attained even with an oil-less system (an embodiment where a release agent, such as an oil, is not applied to a fixing roller).

Preferred examples of the release agent include wax. Examples of wax include natural wax, such as vegetable wax (e.g. carnauba wax, cotton wax, Japan wax, and rice wax), animal wax (e.g., bees wax and lanolin), mineral wax (e.g., ozokelite and ceresin), and petroleum wax (e.g., paraffin wax, microcrystalline wax and petrolatum). Examples of the wax other than the natural wax listed above include synthetic hydrocarbon wax (e.g., Fischer-Tropsch wax, polyethylene wax and polypropylene wax), and synthetic wax (e.g., ester wax, ketone wax and ether wax). Further examples thereof include fatty acid amide (e.g., 12-hydroxystearic acid amide, stearic amide, phthalic anhydride imide, and chlorinated hydrocarbon), a low-molecular-weight crystalline polymer resin, such as a homopolymer of polyacrylate (e.g., poly-n-stearylmethacrylate, and poly-n-laurylmethacrylate) or a copolymer of polyacrylate (e.g., a n-stearyl acrylate-ethyl methacrylate copolymer), and a crystalline polymer having a long alkyl group at a side chain. These may be used alone or in combination.

A melting point of the release agent is appropriately selected depending on the intended purpose without any limitation. The melting point of the release agent is preferably in a range of from 50° C. through 120° C., more preferably a range of from 60° C. through 90° C. When the melting point of the release agent is lower than 50° C., the wax may adversely affect heat resistant storage stability of the resultant toner. When the melting point of the release agent is higher than 120° C., cold offset tends to occur at the time of fixing at a low temperature.

A melt viscosity of the release agent, as measured at the temperature higher than the melting point of the release agent by 20° C., is preferably in a range of from 5 cps through 1,000 cps, more preferably a range of from 10 cps through 100 cps. When the melt viscosity is less than 5 cps, a releasing ability of the toner may be impaired. When the melt viscosity thereof is greater than 1,000 cps, hot offset resistance and low temperature fixing ability of the toner may be impaired.

An amount of the release agent in the toner is appropriately selected depending on the intended purpose without any limitation, but the amount of the release agent is preferably in a range of from 0% by mass through 40% by mass, more preferably a range of from 3% by mass through 30% by mass. When the amount of the release agent is greater than 40% by mass, flowability of the resultant toner may be poor.

The release agent can be added appropriately to either a first resin phase, or a second resin phase by utilizing a difference in affinity to the two resins. By selectively adding the release agent into the second resin phase, which is present at an outer layer of a toner particle, bleeding of the release agent occurs even with a short heating time during fixing, and therefore sufficient releasing properties can be exhibited.

Moreover, the release agent is selectively contained in the first resin phase, which is present at an inner layer of a toner particle, to thereby prevent spent of the release agent to other members, such as a photoconductor, and a carrier. In the present invention, a position of the release agent can be relatively freely set, and the release agent can be appropriately located depending on each image formation process.

<<Other Components>>

The aforementioned other components are appropriately selected depending on the intended purpose without any limitation, and examples of the components include a colorant, a charge controlling agent, inorganic particles, a flow improving agent, a cleaning improving agent, a magnetic material, and a metal soap.

—Colorant—

The colorant for the toner of the present invention is appropriately selected from dyes and pigments known in the art without any limitation. Examples of the colorant include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

These colorants may be used alone or in combination.

An amount of the colorant in the toner is appropriately selected depending on the intended purpose without any limitation, but the amount of the colorant is preferably in a range of from 1% by mass through 15% by mass, more preferably a range of from 3% by mass through 10% by mass. When the amount of the colorant is less than 1% by mass, the resultant toner may be deteriorated in coloring power. When the amount of the colorant is more than 15% by mass, the colorant is not sufficiently dispersed in the toner, and thus the resultant toner may be deteriorated in coloring power and electrical property.

The colorant may be used as a master batch, in which the colorant forms a composite with a resin. The resin is appropriately selected from resins known in the art depending on the intended purpose without any limitation. Examples of the resin include polyester, styrene or a polymer of substituted styrene, a styrene-based copolymer, polymethyl methacrylate, polybutyl methacrylate, polyvinyl chloride, polyvinyl acetate, polyethylene, polypropylene, an epoxy resin, an epoxy polyol resin, polyurethane, polyamide, polyvinyl butyral, a polyacrylic acid resin, rosin, modified rosin, a terpene resin, an aliphatic hydrocarbon resin, an alicyclic hydrocarbon resin, an aromatic petroleum resin, chlorinated paraffin, and paraffin wax. These resins may be used alone or in combination.

Examples of the styrene or the polymer of substituted styrene include polyester resin, polystyrene, poly-p-chlorostyrene, and polyvinyl toluene.

Examples of the styrene-based copolymer include a styrene-p-chlorostyrene copolymer, a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-methyl vinyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer.

The master batch can be produced by mixing or kneading the resin for master batch and the colorant together upon application of high shearing force. In the course of the production of the master batch, an organic solvent is preferably added in order to enhance the interactions between the colorant and the resin.

Moreover, a so-called flashing method is preferably used, since a wet cake of the colorant can be directly used without being dried. The flashing method is a method in which an aqueous paste containing a colorant is mixed or kneaded with a resin and an organic solvent, and then the colorant is transferred to the resin to remove the moisture and the organic solvent.

In the mixing or kneading, for example, a high-shearing disperser (e.g., a three-roll mill) can be used. The colorant can be added appropriately to either a first resin phase, or a second resin phase by utilizing a difference in affinity to the two resins.

It has been widely known that charging performances of a toner is impaired when the colorant is present at surfaces of toner particles. Therefore, the colorant is selectively contained in a first resin phase, which is present in an inner layer of a toner particle, to thereby improve charging performances (e.g., environmental stability, charge retainability, and a charge amount) of the toner.

—Charge Controlling Agent—

The charge controlling agent is appropriately selected from those known in the art depending on the intended purpose without any limitation, and examples thereof include a nigrosine dye, a triphenylmethane dye, a chrome-containing metal complex dye, a molybdic acid chelate pigment, a rhodamine dye, alkoxy amine, a quaternary ammonium salt (including fluorine-modified quaternary ammonium salt), alkylamide, phosphorus or a compound thereof, tungsten or a compound thereof, a fluorosurfactant, a metal salt of salicylic acid, and a metal salt of a salicylic acid derivative. These charge controlling agents may be used alone or in combination.

As for the charge controlling agent, a commercial product may be used. Examples of the commercial product include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD.); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, and quaternary ammonium salt.

The spent of the charge controlling agent to other members, such as a photoconductor and a carrier, can be prevented by adding the charge controlling agent selectively to the resin phase of the toner particle, where the resin phase is present the inner layer of the toner. In the production method of the toner of the present invention, a position of the charge controlling agent can be relatively freely set, and the charge controlling agent can be appropriately located depending on each image formation process.

An amount of the charge controlling agent in the toner cannot be defined unconditionally, as the amount of the charge controlling agent varies depending on a type of the resin for use, presence of additives, and a dispersion method. For example, the amount of the charge controlling agent is preferably in a range of from 0.1 parts by mass through 10 parts by mass, more preferably a range of from 0.2 parts by mass through 5 parts by mass relative to 100 parts by mass of the binder resin. When the amount of the charge controlling agent is less than 0.1 parts by mass, a desirably charge controlling ability may not be attained. When the amount of the charge controlling agent is greater than 10 parts by mass, the electrostatic propensity of the resultant toner is excessively large, and therefore an effect of the charge controlling agent is reduced and electrostatic force to a developing roller increases, which may reduce flowability of the toner, or reduce image density of images formed with the resultant toner.

—Flow Improving Agent—

The flow improving agent is used for carrying out a surface treatment to increase hydrophobicity, to thereby prevent degradations of flowability and charging properties of the toner in a high-humidity environment. Examples of the flow improving agent include a silane coupling agent, a sililation agent, a silane-coupling agent containing a fluoroalkyl group, an organic titanate-based coupling agent, an aluminum-based coupling agent, silicone oil, and modified-silicone oil. It is particularly preferred that the silica and the titanium oxide be surface-treated with the aforementioned flow improving agent, and used as hydrophobic silica, and hydrophobic titanium oxide.

—Cleaning Improving Agent—

The cleaning improving agent is added to a toner in order to remove any residual developer on a photoconductor, or a primary transfer member. Examples of the cleaning improving agent include fatty acid (e.g. stearic acid) metal salt (e.g., zinc stearate, and calcium stearate), and polymer particles produced by soap-free emulsification polymerization, such as polymethyl methacrylate particles, and polystyrene particles. The polymer particles preferably have a relatively narrow particle size distribution, and the volume average particle diameter thereof is preferably in a range of from 0.01 μm through 1 μm.

—Layered Inorganic Mineral—

The layered inorganic mineral may be optionally added to the toner. The layered inorganic mineral is inorganic mineral, in which layers each having a thickness of several nanometers are laminated. The modification of the layered inorganic mineral is to introduce organic ions to ions present between the layers. As for the layered inorganic mineral, smectite group minerals (e.g., montmorillonite, and saponite), kaolin group minerals (e.g., kaolinite), magadiite, and kanemite are known. The modified layered inorganic mineral has high hydrophilicity due to the modified layer structure of the layered inorganic mineral.

If the layered inorganic mineral is dispersed in an aqueous medium and is used for granulation of a toner without being modified, therefore, the layered inorganic mineral is transferred into the aqueous medium, hence the layered inorganic mineral cannot change its shape. When the layered inorganic mineral is modified, hydrophilicity of the layered inorganic mineral is enhanced, and therefore the modified layered inorganic mineral is turned into small pieces and changes the shape during the production of the toner. As a result, a large amount of the layered inorganic mineral is present particularly on surface areas of the toner particles, to exhibit a charge controlling function, and contribute to low temperature fixing. An amount of the modified layered inorganic mineral in the toner materials is preferably in a range of from 0.05% by mass through 5% by mass.

—Inorganic Particles—

The inorganic particles are used as external additives for imparting flowability, developing ability and charging ability to the toner particles. The inorganic particles are appropriately selected from those known in the art depending on the intended purpose without any limitation. Examples of the inorganic particles include silica, alumina, titanium oxide, barium titanate, magnesium titanate, calcium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. These inorganic particles may be used alone or in combination.

(Developer)

The developer for use in the present invention may be a one-component developer, or a two-component developer containing a carrier. Moreover, the toner of the present invention may be used as a one-component magnetic toner without using carrier, or a non-magnetic toner.

In the case where the toner of the present invention is used for a two-component developer, the toner is used by mixing with a magnetic carrier. As for the blending ratio of the carrier and the toner in the developer, the toner is preferably in a range of from 1 part by mass through 10 parts by mass, relative to 100 parts by mass of the carrier.

As for the magnetic carrier, a conventional carrier known in the art, such as an iron powder, ferrite powder, magnetite powder, and magnetic resin carrier each having a particle diameter in a range of from about 20 μm through about 200 μm, can be used.

Moreover, a resin-coated carrier prepared by coating magnetic particles (e.g., iron, and ferrite) with a coating material (e.g., a resin), or a binder carrier prepared by dispersing a magnetic powder in a binder resin can be used.

Examples of the coating material include an amino-based resin, such as a urea-formaldehyde resin, a melamine resin, a guanamine resin, a urea resin, and a polyamide resin.

Examples of the coating material further include a polyvinyl or polyvinylidene-based resin (e.g., an acrylic resin, a polymethyl methacrylate resin, a polyacrylonitrile resin, a polyvinyl acetate resin, a polyvinyl alcohol resin, and a polyvinyl butyral resin), a polystyrene-based resin (e.g., a polystyrene resin, and a styrene-acryl copolymer resin), a halogenated olefin resin (e.g., polyvinyl chloride), a polyester-based resin (e.g., a polyethylene terephthalate resin, and a polybutylene terephthalate resin), a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer (e.g., a terpolymer of tetrafluoroethylene, vinylidene fluoride, and a non-fluoromonomer), a silicone resin, and an epoxy resin.

Moreover, a conductive powder may be optionally added to the coating resin. As for the conductive powder, a metal powder, carbon black, titanium oxide, tin oxide, or zinc oxide can be used. These conductive powders preferably have the average particle diameter of 1 μm or smaller. When the average particle diameter of the conductive powder is greater than 1 μm, it is difficult to control electric resistance.

(Toner Stored Unit)

The toner stored unit of the present invention includes a unit having a function of storing a toner, and a toner stored in the unit. Examples of the embodiment of the toner stored unit include a toner stored container, a developing device, and a process cartridge.

The toner stored container is a container containing a toner stored therein.

The developing device includes a unit storing a toner therein, and configured to perform developing.

The process cartridge integrally includes an image bearer and a developing unit, stores a toner, and is detachably mounted to an image forming apparatus. The process cartridge may further include at least one selected from the group consisting a charging unit, an exposing unit, and a cleaning unit.

A toner stored unit of the present invention is mounted on an image forming apparatus to form an image, and thus the image is formed using the toner of the present invention. Accordingly, excellent low temperature fixing ability is attained, and excellent storage stability and charge stability are achieved, as well as attaining storage stability and charge stability that are hardly influenced by a temperature and humidity of an environment.

(Image Forming Apparatus)

The image forming apparatus of the present invention includes an image bearer (an electrostatic latent image bearer), an electrostatic latent image forming unit (a charging unit and an exposing unit), a developing unit, a transferring unit, and a fixing unit. The image forming apparatus may further contain units, such as a cleaning unit, a charge-eliminating unit, a recycling unit, and a controlling unit, if necessary.

The image forming method for use in the present invention includes an electrostatic latent image forming step (a charging step and an exposing step), a developing step, a transferring step, and a fixing step. The image forming method may further include steps, such as a cleaning step, a charge-eliminating step, a recycling step, and a controlling step, if necessary.

The electrostatic latent image forming step is a step including forming an electrostatic latent image on an image bearer (an electrostatic latent image bearer). A material, shape, structure, and size of the image bearer are appropriately selected from those known in the art. Examples of the material include: an inorganic material, such as amorphous silicon, and selenium; and an organic material, such as polysilane, and phtharopolymethine. Among them, amorphous silicon is preferable because of its long service life. Moreover, the shape of the image bearer is preferably a drum shape.

An electrostatic latent image can be formed by uniformly charging a surface of the image bearer, followed by exposing the charged surface of the image bearer with image wise light. The formation of the electrostatic latent image can be performed by the electrostatic latent image forming unit. The electrostatic latent image forming unit preferably includes a charger (a charging unit) configured to uniformly charge a surface of the image bearer, and an exposure device (an exposing unit) configured to expose the surface of the image bearer to light.

The charging can be performed by applying voltage to the surface of the image bearer using the charger. The charger is appropriately selected depending on the intended purpose. Examples of the charger include a conventional contact charger equipped with an electroconductive or semiconductive roller, brush, film, or rubber blade, and a non-contact charger utilizing corona discharge, such as corotron, and scorotron.

The exposure can be performed by exposing the surface of the image bearer to light using the exposure device. The exposure device is appropriately selected depending on the intended purpose. As for the exposure device, various exposure devices, such as a reproduction optical exposure device, a rod-lens array exposure device, a laser optical exposure device, and a liquid crystal shutter optical device, can be used. Note that, an exposure device of a back light system, where exposure is performed from a back side of the photoconductor, may be used.

The developing step is a step including developing the electrostatic latent image with the toner of the present invention to form a visible image. The visible image can be formed by the developing unit. The developing unit is appropriately selected from those known in the art. It is preferred that the developing unit house the toner of the present invention therein, and contain a developing device capable of applying the toner to the electrostatic latent image in a direct-contact or non-contact manner. The developing device may be a developing device for a single color, or a developing device for multiple colors. Specific examples of the developing device include a developing device equipped with a stirrer configured to stir the developer to cause frictions to thereby charge the developer, and a rotatable magnet roller.

In the developing device, the toner and a carrier are mixed and stirred, and the toner is charged with the friction caused by the mixing and stirring. The charged toner is held on a surface of a rotating magnetic roller in a form of a brush, to thereby form a magnetic brush. The magnet roller is disposed adjacent to the image bearer, and therefore part of the toner constituting the magnetic brush on the surface of the magnetic roller is moved to the surface of the image bearer by an electric suction force. As a result, the electrostatic latent image is developed with the toner to thereby form a visible image composed of the toner on the surface of the image bearer.

The transferring step is a step including transferring the visible image onto a recording medium. It is preferred that the transferring step use an intermediate transfer member, and include primary transferring the visible image onto the intermediate transfer member, followed by secondary transferring the visible image onto a recording medium. The toner for use is typically a toner of two or more colors, preferably a full-color toner. Accordingly, the transferring step preferably includes a primary transferring step, which includes transferring the visible images of different colors onto the intermediate transfer member to form a composite transfer image, and a secondary transferring step, which include transferring the composite transfer image onto a recording medium.

The transferring can be performed by charging the image bearer using the transferring unit. The transferring unit preferably includes a primary transferring unit configured to transfer the visible images of different colors onto the intermediate transfer member to form a composite transfer image, and a secondary transferring unit configured to transfer the composite transfer image onto a recording medium. Note that, the intermediate transfer member is appropriately selected from transferring members known in the art. As for the intermediate transfer member, a transfer belt can be used.

The transferring unit preferably includes a transferring device configured to charge the visible image formed on the image bearer to separate the visible image from the image bearer to the side of a recording medium. The number of the transferring units to be mounted may be one, or two or more. Specific examples of the transferring device include a corona transferring device using corona discharge, a transfer belt, a transfer roller, a pressure transfer roller, and an adhesion transfer device. Note that, the recording medium is appropriately selected from recording media known in the art. As for the recording medium, recording paper can be used.

The fixing step is a step including fixing the visible image transferred onto the recording medium using the fixing unit. The fixing may be performed every time the toner of each color is transferred onto the recording medium, or may be performed once in the state where toners of all colors are laminated. The fixing unit is appropriately selected depending on the intended purpose. As for the fixing unit, a conventional heating and pressing member can be used. Examples of the heating and pressing member include a combination of a heating roller and a pressing roller, and a combination of a heating roller, a pressing roller, and an endless belt. The heating by the heating and pressing member is typically preferably performed at a temperature in a range of from 80° C. through 200° C. Note that, a conventional optical fixing device may be used in combination with or instead of the fixing unit, depending on the intended purpose.

The charge-eliminating step is a step including applying charge-eliminating bias to the image bearer to eliminate charges of the image bearer. The charge-eliminating step can be carried out by the charge-eliminating unit. The charge-eliminating unit can be appropriately selected from conventional charge neutralizers known in the art. As for the charge-eliminating unit, a charge-eliminating lamp can be used.

The cleaning step is a step including removing the toner remained on the image bearer, and the cleaning step can be carried out by the cleaning unit. The cleaning unit is appropriately selected conventional cleaners known in the art. As for the cleaning unit, a magnetic brush cleaner, an electrostatic brush cleaner, a magnetic roller cleaner, a blade cleaner, a brush cleaner, or a web cleaner can be used. A blade cleaner is preferably used as the cleaning unit.

The recycling step is a step including recycling, in the developing unit, the toner removed during the cleaning step. The recycling step can be carried out by the recycling unit. The recycling unit is appropriately selected depending on the intended purpose. As for the recycling unit, a conventional conveying unit can be used.

The controlling step is a step including controlling each step. The controlling step can be carried out by the controlling unit. The controlling unit is appropriately selected depending on the intended purpose. As for the controlling unit, a device, such as a sequencer, and a computer, can be used Moreover, the process cartridge for use in the present invention integrally includes an image bearer (electrostatic latent image bearer), and a developing unit configured to develop an electrostatic latent image formed on the electrostatic latent image bearer with the toner of the present invention, and is detachably mounted to a main body of the image forming apparatus. Note that, the process cartridge may include other units, such as a charging unit, and a cleaning unit.

Figure 2:
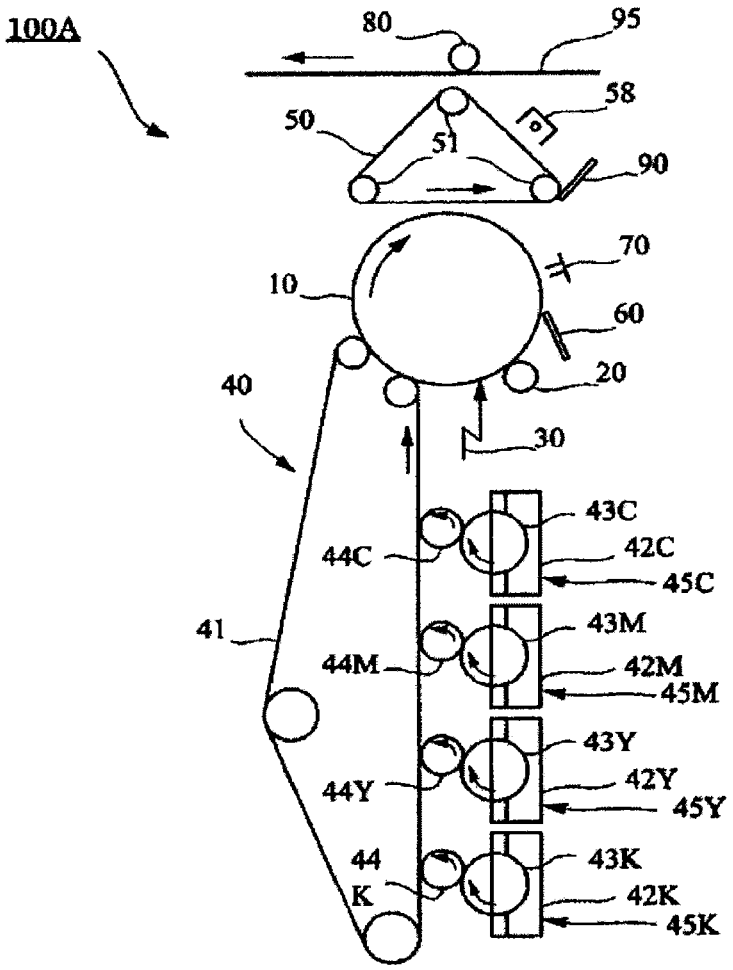
FIG. 2 is a schematic view illustrating one example of the image forming apparatus according to the present invention.

One example of the image forming apparatus for use in the present invention is illustrated in FIG. 2. The image forming apparatus 100A includes a drum-shaped photoconductor 10 serving as an image bearer, a charging roller 20 serving as a charging unit, an exposing device 30 serving as an exposing unit, a developing device 40 serving as a developing unit, an intermediate transfer member 50, a cleaning device 60 serving as a cleaning unit, and a charge-eliminating lamp 70 serving as a charge-eliminating unit.

The intermediate transfer member 50 is an endless belt, and is designed to rotate in the direction indicated with an arrow by three rollers 51 disposed inside the intermediate transfer member 50 to support the intermediate transfer member 50. Part of the three rollers 51 also functions as a transfer bias roller capable of applying a predetermined transfer bias (primary transfer bias) to the intermediate transfer member 50. In the surrounding area of the intermediate transfer member 50, the cleaning device 90 having a cleaning blade is disposed.

Moreover, the transfer roller 80 serving as the transferring unit capable of applying a transfer bias for transferring (secondary transferring) a developed image (i.e. the toner image) to a recording paper 95 serving as a recording medium is disposed to face the intermediate transfer member 50. In the surrounding area of the intermediate transfer member 50, the corona charger 58, which is configured to apply a charge to the toner image on the intermediate transfer member 50, is disposed in the area situated between the contact area of the photoconductor 10 and the intermediate transfer member 50, and the contact area of the intermediate transfer member 50 and the transfer paper 95, in the rotation direction of the intermediate transfer member 50.

The developing device 40 includes a developing belt 41 serving as a developer bearer, and a black developing device 45K, a yellow developing device 45Y, a magenta developing device 45M, and a cyan developing device 45C, which are disposed in the surrounding area of the developing belt 41.

Note that, the black developing device 45K is equipped with a developer storage unit 42K, a developer supply roller 43K, and a developing roller 44K; the yellow developing device 45Y is equipped with a developer storage unit 42Y, a developer supply roller 43Y, and a developing roller 44Y; the magenta developing device 45M is equipped with a developer storage unit 42M, a developer supply roller 43M, and a developing roller 44M; and the cyan developing device 45C is equipped with a developer storage unit 42C, a developer supply roller 43C, and a developing roller 44C. Moreover, the developing belt 41 is an endless belt, which is rotatably supported by a plurality of belt rollers, and at part of which is in contact with the photoconductor 10.

In the image forming apparatus 100A, the charging roller 20 uniformly charge the photoconductor 10, followed by exposing the photoconductor 10 using the exposing device 30, to thereby form an electrostatic latent image. Next, the developer is supplied from the developing device 40 to the electrostatic latent image formed on the photoconductor 10 to thereby develop the electrostatic latent image to form a toner image. Moreover, the toner image is transferred (primary transferred) to the intermediate transfer member 50 by the voltage applied from the roller 51, and is then transferred (secondary transferred) to recording paper 95. As a result, a transferred image is formed on the recording paper 95. Note that, the toner remained on the photoconductor 10 is removed by the cleaning device 60 having a cleaning blade, and the charge of the photoconductor 10 is neutralized by the charge-eliminating lamp 70.

Figure 3:
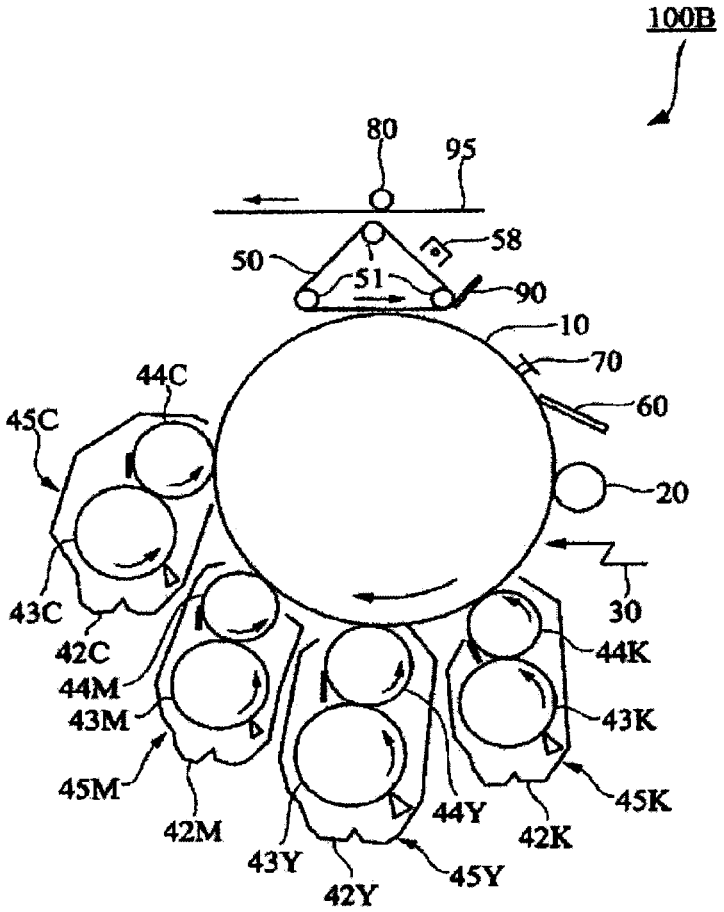
FIG. 3 is a schematic view illustrating another example of the image forming apparatus according to the present invention.

Another example of the image forming apparatus for use in the present invention is illustrated in FIG. 3. The image forming apparatus 100B has the same structure and exhibits the same effects to those of the image forming apparatus 100A, provided that the image forming apparatus 100B is not equipped with a developing belt 41, and a black developing unit 45K, a yellow developing unit 45Y, a magenta developing unit 45M, and a cyan developing unit 45C are disposed to face the photoconductor 10 in a surrounding area of the photoconductor 10. Note that, the reference numbers of FIG. 3, which are also used in FIG. 2, denote the same to those in FIG. 2.

Figure 4:
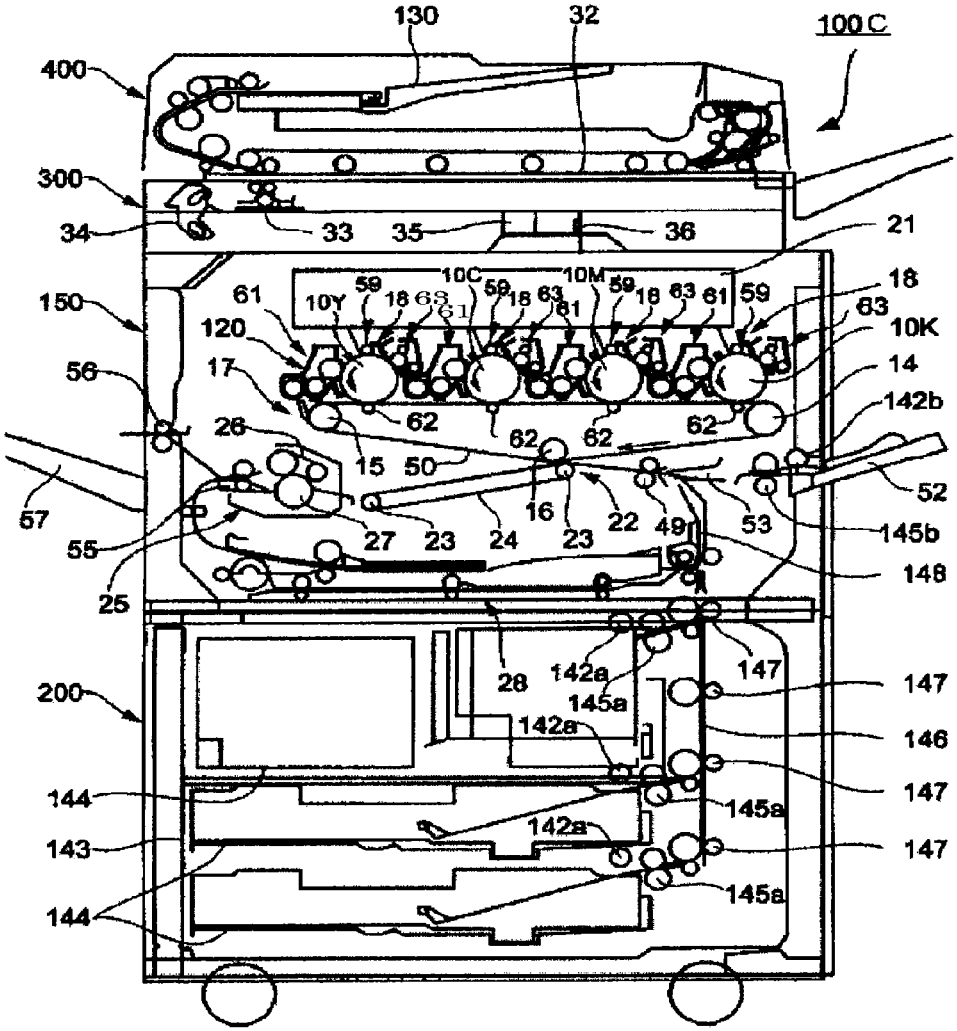
FIG. 4 is a schematic view illustrating another example of the image forming apparatus according to the present invention.

Another example of the image forming apparatus for use in the present invention is illustrated in FIG. 4. The image forming apparatus 100C is a tandem color image forming apparatus. The image forming apparatus 100C include a copier main body 150, a paper feeding table 200, a scanner 300, and an automatic document feeder 400. In the central part of the copier main body 150, an intermediate transfer member 50 in the form of an endless belt is disposed.

The intermediate transfer member 50 is supported by support rollers 14, 15, and 16 in the clockwise direction in FIG. 4. In the surrounding area of the support roller 15, an intermediate transfer member cleaning device 17 configured to remove the toner remained on the intermediate transfer member 50 is disposed. To the intermediate transfer member 50 supported by the support roller 14 and the support roller 15, a tandem developing device 120, in which four image forming units 18, i.e. yellow, cyan, magenta, and black image forming units, are aligned along the traveling direction of the intermediate transfer member 50, is disposed.

In the surrounding area of the tandem developing device 120, an exposing device 21 is disposed. A secondary transferring device 22 is disposed at the opposite side of the intermediate transfer member 50 to the side where the tandem developing device 120 is disposed. In the secondary transferring device 22, a secondary transfer belt 24, which is an endless belt, is supported by a pair of rollers 23, and is designed in a manner that the recording paper transported on the secondary transfer belt 24 and the intermediate transfer member 50 can be in contact with each other. In the surrounding area of the secondary transferring device 22, a fixing device 25 is disposed. The fixing device 25 is equipped with a fixing belt 26, which is an endless belt, and a pressure roller 27 disposed so as to press against the fixing belt 26.

Note that, in the image forming apparatus 100C, a sheet reverser 28, which is configured to reverse the transfer paper to perform image formation on both sides of the transfer paper, is provided in the surrounding area of the secondary transferring device 22 and the fixing device 25. Owing to the sheet reverser, images can be formed on both sides of recording paper.

Next, formation of a full-color image (color copy) using the tandem developing device 120 is explained. First, a document is set on a document table 130 of the automatic document feeder 400. Alternatively, the automatic document feeder 400 is opened, a document is set on a contact glass 32 of the scanner 300, and then the automatic document feeder 400 is closed.

In the case where the document is set on the automatic document feeder 400, once a start switch is pressed, the document is transported onto the contact glass 32, and then the scanner 300 is driven to scan the document with a first travelling body 33 equipped with a light source and a second travelling body 34 equipped with a mirror. In the case where the document is set on the contact glass 32, the scanner 300 is immediately driven in the same manner as mentioned.

During this scanning operation, light applied from a light source of the first travelling body 33 is reflected on the surface of the document, the reflected light from the document is further reflected by a mirror of the second travelling body 34, and passed through an image forming lens 35, which is then received by a read sensor 36. In this manner, the color document (color image) is read, and image information of black, yellow, magenta, and cyan is obtained. The image information of each color, black, yellow, magenta or cyan, is transmitted to respective image forming unit 18 (a black image forming unit, a yellow image forming unit, a magenta image forming unit, and a cyan image forming unit) of the tandem developing device 120, to thereby form a toner image of each color.

A toner image formed on the photoconductor for black 10K, a toner image formed on the photoconductor for yellow 10Y, a toner image formed on the photoconductor for magenta 10M, and a toner image formed on the photoconductor for cyan 10C are sequentially transferred (primary transferred) to the intermediate transfer member 50. On the intermediate transfer member 50, the black toner image, the yellow toner image, the magenta toner image, and the cyan toner image are superimposed to form a composite toner image (color transfer image).

Figure 5:
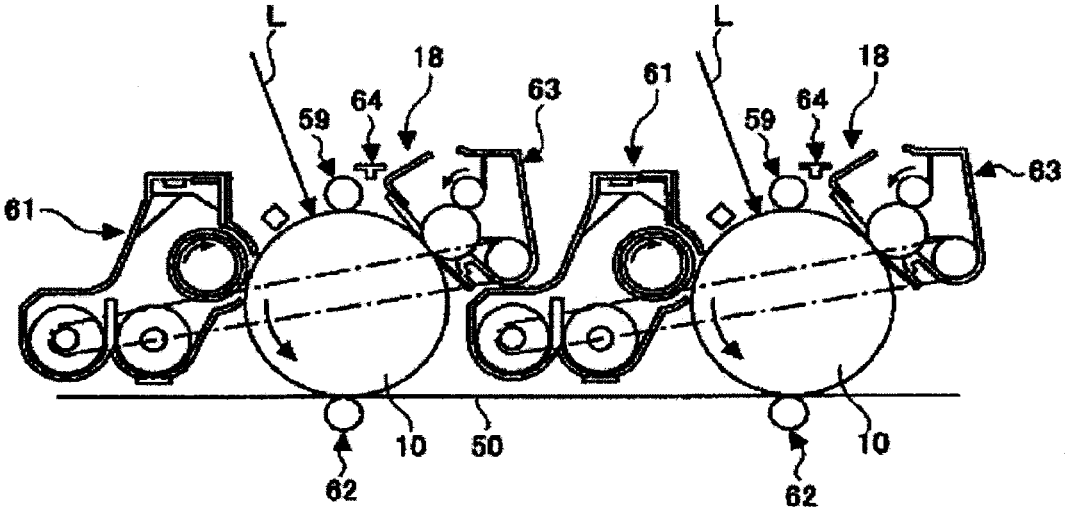
FIG. 5 is a schematic view illustrating part of the image forming apparatus of FIG. 4.

As illustrated in FIG. 5, the image forming unit 18 of each color in the tandem developing device 120 contains the photoconductor 10, the charger 59 configured to uniformly charge the photoconductor 10, the exposing device 21 configured to apply light (L in FIG. 5) to the photoconductor 10 based on the image information of each color to form an electrostatic latent image on the photoconductor 10, the developing device 61 configured to develop the electrostatic latent image with the toner of each color to form a toner image of each color on the photoconductor 10, and a transfer charger 62 configured to transfer the toner image of each color to the intermediate transfer member 50, the photoconductor cleaning device 63, and the charge-eliminating device 64.

In the paper feeding table 200, one of the paper feeding rollers 142*a* is selectively rotated to eject recording paper from one of multiple feeder cassettes 144 of a paper bank 143, the ejected sheets are separated one by one by a separation roller 145*a* to send to a feeder path 146, and then transported by a transport roller 147 into a feeder path 148 within the apparatus main body 150. The recording paper transported in the feeder path 148 is then bumped against a registration roller 49 to stop.

Alternatively, recording paper on a bypass feeder 52 are ejected by rotating a paper feeding roller 142*b*, separated one by one by a separation roller 145*b* to guide into a manual paper feeding path 53, and then bumped against the registration roller 49 to stop. Note that, the registration roller 49 is generally earthed at the time of the use, but bias may be applied to the registration roller 49 for removing paper dust of the recording paper.

Next, the registration roller 49 is rotated synchronously with the movement of the color transfer image formed on the intermediate transfer member 50, to thereby send the recording paper between the intermediate transfer member 50 and the secondary transferring device 22. As a result, the color transfer image is formed on the recording paper. Note that, the toner remained on the intermediate transfer member 50 after the transferring is cleaned by the intermediate transfer member cleaning device 17.

The recording paper, on which the color transfer image has been formed, is transported to the fixing device 25 by the secondary transferring device 22. In the fixing device 25, the color transfer image is fixed on the recording paper by heat and pressure. Thereafter, the traveling direction of the recording paper is changed by the switch craw 55 to eject the recording paper by the ejecting roller 56. The ejected recording paper is stacked on the paper ejection tray 57. Alternatively, the traveling direction of the recording paper is changed by the switch craw 55, and the recording paper is reversed by the sheet reverser 28 to send the recording paper again to the transfer position, to thereby record an image on the back side thereof. Then, the recording paper is ejected by the ejecting roller 56, and stacked on the paper ejection tray 57.

EXAMPLES

The present invention is more specifically described through Examples hereinafter, but Examples shall not be construed as to limit the scope of the present invention. Note that, in the descriptions of Examples, "%" denotes "% by mass," and "part(s)" denotes "part(s) by mass."

Example 1

—Synthesis Example of Polyester Resin 1—

A reaction vessel equipped with a nitrogen-inlet tube, a condenser, a stirrer, and a thermocouple was charged with 376 parts of bisphenol A propylene oxide (2 mol) adduct (bisPhPO2) and 109 parts of bisphenol A propylene oxide (3 mol) adduct (bisPhPO3) at a molar ratio (bisPhPO2/bisPhPO3) of 80/20, and 116 parts of isophthalic acid and 44 parts of adipic acid at a molar ratio (isophthalic acid/adipic acid) of 70/30 and OH/COOH of 1.33. The resultant mixture was allowed to react together with 500 ppm of titanium tetraisopropoxide for 10 hours at 230° C. under normal pressure. Subsequently, 26 parts of benzoic acid was added to the reaction vessel, and the resultant mixture was allowed to react for 5 hours under the reduced pressure of 10 mmHg to 15 mmHg. Thereafter, 11 parts of trimellitic anhydride was added to the reaction vessel, and the resultant mixture was allowed to react for 3 hours at 180° C. under normal pressure, to thereby obtain amorphous [Polyester Resin 1].

—Preparation of Aqueous Phase—

Water (990 parts), 83 parts of [Polyester Resin 1], 37 parts of a 48.5% sodium dodecyldiphenyl ether disulfonate aqueous solution (ELEMINOL MON-7, manufactured by Sanyo Chemical Industries, Ltd.), and 90 parts of ethyl acetate were mixed and stirred, to thereby obtain a milky white liquid. The obtained liquid was provided as [Aqueous Phase 1].

—Production of Crystalline Resin—

A reaction tank equipped with a cooling tube, a stirrer, and a nitrogen-inlet tube was charged with 241 parts of sebacic acid, 55 parts of adipic acid, 314 parts of 1,4-butanediol, and 0.75 parts of titanium dihydroxybis(triethanol aminate) serving as a condensation catalyst. The resultant mixture was allowed to react at 180° C. for 4 hours under a nitrogen flow, while generated water was distilled off. Subsequently, the resultant was further allowed to react for 3 hours under a nitrogen flow while the temperature was gradually elevated to 225° C., and generated water and 1,4-butanediol were distilled off. Furthermore, the resultant was allowed to react under the reduced pressure of 5 mmHg to 20 mmHg, until the weight average molecular weight (Mw) of the reaction product reached about 1,200. As a result, [Crystalline Resin'] was obtained.

To a reaction tank equipped with a cooling tube, a stirrer, and a nitrogen-inlet tube, 218 parts of [Crystalline Resin'] as obtained was transferred. To the reaction tank, 250 parts of ethyl acetate, 40 parts of hexamethylene diisocyanate (HDI), 25 parts of maleic anhydride were further added, and the resultant mixture was allowed to react at 80° C. for 5 hours under a nitrogen flow. Subsequently, the ethyl acetate was removed under the reduced pressure, to thereby obtain [Crystalline Resin].

—Synthesis of Polyester Prepolymer—

A reaction vessel equipped with a cooling tube, a stirrer, and a nitrogen-inlet tube was charged with 682 parts of bisphenol A ethylene oxide (2 mol) adduct, 81 parts of bisphenol A propylene oxide (2 mol) adduct, 283 parts of terephthalic acid, 22 parts of trimellitic anhydride, and 2 parts of dibutyl tin oxide, and the resultant mixture was allowed to react at 230° C. for 8 hours under normal pressure, followed by reacting for 5 hours under the reduced pressure of 10 mmHg to 15 mmHg, to thereby obtain [Intermediate Polyester]. [Intermediate Polyester] had the number average molecular weight of 2,100, the weight average molecular weight of 9,500, Tg of 55° C., the acid value of 0.5, and the hydroxyl value of 51.

Subsequently, a reaction vessel equipped with a cooling tube, a stirrer, and a nitrogen-inlet tube was charged with 410 parts of [Intermediate Polyester], 89 parts of isophorone diisocyanate, and 500 parts of ethyl acetate, and the resultant mixture was allowed to react at 100° C. for 5 hours, to thereby obtain [Polyester Prepolymer].

—Synthesis of Ketimine Compound (Active Hydrogen Group-Containing—Compound)—

A reaction vessel, to which a stirring bar and a thermometer had been set, was charged with 170 parts of isophorone diamine and 75 parts of methyl ethyl ketone, and the resultant mixture was allowed to react at 50° C. for 5 hours, to thereby synthesize [Ketimine Compound](active hydrogen group-containing compound). The obtained ketamine compound had the amine value of 418.

—Production of Master Batch—

After mixing 100 parts of [Polyester Resin 1] and 100 parts of a cyan pigment (C.I. Pigment blue 15:3) by means of HENSCHEL MIXER (manufactured by Mitsui Mining Co., Ltd.) for 5 minutes at 1,000 rpm, the resultant mixture was kneaded by an open roll kneader (manufactured by Mitsui Mining Co., Ltd.). The kneaded product was pulverized into a pigment dispersion powder in the size of 2 mm by means of Rotoplex Crusher, to thereby produce [Master Batch].

—Production of Wax Dispersion Liquid—

A vessel was charged with 20 parts of carnauba wax, 80 parts of [Polyester Resin 1], and 120 parts of ethyl acetate, and the resultant mixture was heated to 78° C. to sufficiently dissolve the wax and the resin. Thereafter, the mixture was cooled to 30° C. over 1 hour with stirring. Thereafter, the resultant was subjected to wet pulverization at 40° C. by means of ULTRA VISCOMILL, (manufactured by AIMEX CO., Ltd.) under the conditions where the liquid feed rate was 1.0 Kg/hr, the f-disc circumferential velocity was 10 m/sec, the filling amount of the 0.5 mm-zirconia beads was 80% by volume, and the number of passes was 6, to thereby produce [Wax Dispersion Liquid].

—Production of Toner 1—

A vessel equipped with a thermometer and a stirrer was charged with 20 parts of [Crystalline Resin] and 24 parts of ethyl acetate, and the resin was sufficiently dissolved with heating to the temperature equal to or higher than the melting point of the resin. To the vessel, 102 parts of 50% [Polyester Resin 1] ethyl acetate solution, 66 parts of [Wax Dispersion Liquid], 10 parts of [Master Batch], 12 parts of [Polyester Prepolymer], and 2 parts of [Ketamine Compound] were further added, and the resultant mixture was stirred at 50° C. by means of TK Homomixer (manufactured by PRIMIX Corporation) at the rotational speed of 10,000 rpm to sufficiently dissolve and disperse, to thereby obtain [Oil Phase 1].

Subsequently, 50 parts of [Oil Phase 1], the temperature of which was kept at 20° C., was added to 75 parts of [Aqueous Phase 1], and the resultant mixture was mixed for 1 minute by means of TK Homomixer (manufactured by PRIMIX Corporation) at the rotational speed of 13,000 rpm, to thereby obtain [Slurry 1].

After filtering 100 parts of [Slurry 1] of toner base particles as obtained under the reduced pressure, the following washing treatment of (1) to (4) was performed.

(1) To the filtration cake, 100 parts of ion-exchanged water was added, and the mixture was mixed (for 5 minutes at the rotational speed of 6,000 rpm) by TK Homomixer, followed by filtering the mixture.

(2) To the filtration cake obtained in (1), 100 parts of a 10% sodium hydroxide aqueous solution was added, and the mixture was mixed (for 10 minutes at the rotational speed of 6,000 rpm) by TK Homomixer, followed by filtering the mixture under the reduced pressure.

(3) To the filtration cake obtained in (2), 100 parts of 10% hydrochloric acid was added, and the mixture was mixed (for 5 minutes at the rotational speed of 6,000 rpm) by TK Homomixer, followed by filtering the mixture.

(4) To the filtration cake obtained in (3), 300 parts of ion-exchanged water was added, and the mixture was mixed (for 5 minutes at the rotational speed of 6,000 rpm) by the TK Homomixer, followed by filtering the mixture. This series of the operations was performed twice, to thereby obtain [Filtration Cake 1].

[Filtration Cake 1] as obtained was dried with an air-circulating drier for 48 hours at 40° C. Thereafter, the dried cake was sieved through a mesh having an opening size of 75 μm, to thereby produce [Toner Base Particles 1].

Subsequently, 1.0 part of hydrophobic silica (HDK-2000, manufactured by Wacker Chemie AG) was added to 100 parts of [Toner Base Particles 1] as obtained, and the mixture was mixed by means of HENSCHEL MIXER, to thereby produce [Toner 1].

Example 2

—Production of Toner 2—

[Polyester Resin 2] was obtained in the same manner as in the synthesis example of [Polyester Resin 1] in Example 1, provided that the amount of the benzoic acid for use was changed from 26 parts to 21 parts. [Toner 2] was obtained in the same manner as in the production of the toner in Example 1, provided that [Polyester Resin 1] was replaced with [Polyester Resin 2].

Example 3

—Production of Toner 3—

[Polyester Resin 3] was obtained in the same manner as in the synthesis example of [Polyester Resin 1] in Example 1, provided that the amount of the benzoic acid for use was changed from 26 parts to 16 parts. [Toner 3] was obtained in the same manner as in the production of the toner in Example 1, provided that [Polyester Resin 1] was replaced with [Polyester Resin 3].

Example 4

—Production of Toner 4—

[Polyester Resin 4] was obtained in the same manner as in the synthesis example of [Polyester Resin 1] in Example 1, provided that the molar ratio of isophthalic acid to adipic acid was changed from 70/30 to 50/50. [Toner 4] was obtained in the same manner as in the production of the toner in Example 1, provided that [Polyester Resin 1] was replaced with [Polyester Resin 4].

Example 5

—Production of Toner 5—

[Polyester Resin 5] was obtained in the same manner as in the synthesis example of [Polyester Resin 1] in Example 1, provided that the molar ratio of isophthalic acid to adipic acid was changed from 70/30 to 50/50, and the amount of benzoic acid for use was changed from 26 parts to 21 parts. [Toner 5] was obtained in the same manner as in the production of the toner in Example 1, provided that [Polyester Resin 1] was replaced with [Polyester Resin 5].

Example 6

—Production of Toner 6—

[Polyester Resin 6] was obtained in the same manner as in the synthesis example of [Polyester Resin 1] in Example 1, provided that the molar ratio of isophthalic acid to adipic acid was changed from 70/30 to 50/50, and the amount of benzoic acid for use was changed from 26 parts to 16 parts. [Toner 6] was obtained in the same manner as in the production of the toner in Example 1, provided that [Polyester Resin 1] was replaced with [Polyester Resin 6].

Example 7

—Production of Toner 7—

[Polyester Resin 7] was obtained in the same manner as in the synthesis example of [Polyester Resin 1] in Example 1, provided that the molar ratio of isophthalic acid to adipic acid was changed from 70/30 to 80/20. [Toner 7] was obtained in the same manner as in the production of the toner in Example 1, provided that [Polyester Resin 1] was replaced with [Polyester Resin 7].

Example 8

—Production of Toner 8—

[Polyester Resin 8] was obtained in the same manner as in the synthesis example of [Polyester Resin 1] in Example 1, provided that the molar ratio of isophthalic acid to adipic acid was changed from 70/30 to 80/20, and the amount of benzoic acid for use was changed from 26 parts to 21 parts. [Toner 8] was obtained in the same manner as in the production of the toner in Example 1, provided that [Polyester Resin 1] was replaced with [Polyester Resin 8].

Example 9

—Production of Toner 9—

[Polyester Resin 9] was obtained in the same manner as in the synthesis example of [Polyester Resin 1] in Example 1, provided that the molar ratio of isophthalic acid to adipic acid was changed from 70/30 to 80/20, and the amount of benzoic acid for use was changed from 26 parts to 16 parts. [Toner 9] was obtained in the same manner as in the production of the toner in Example 1, provided that [Polyester Resin 1] was replaced with [Polyester Resin 9].

Example 10

—Production of Toner 10—

[Polyester Resin 10] was obtained in the same manner as in the synthesis example of [Polyester Resin 1] in Example 1, provided that the ratio OH/COOH was changed from 1.33 to 1.35. [Toner 10] was obtained in the same manner as in the production of the toner in Example 1, provided that [Polyester Resin 1] was replaced with [Polyester Resin 10].

Example 11

—Production of Toner 11—

[Polyester Resin 11] was obtained in the same manner as in the synthesis example of [Polyester Resin 1] in Example 1, provided that the ratio OH/COOH was changed from 1.33 to 1.31. [Toner 11] was obtained in the same manner as in the production of the toner in Example 1, provided that [Polyester Resin 1] was replaced with [Polyester Resin 11].

Example 12

—Production of Toner 12—

[Toner 12] was obtained in the same manner as in the production of the toner in Example 1, provided that the amount of [Crystalline Resin] was changed from 20 parts to 23 parts, and [Polyester Resin 1] was replaced with [Polyester Resin 4].

Example 13

—Production of Toner 13—

[Toner 13] was obtained in the same manner as in the production of the toner in Example 1, provided that the amount of [Crystalline Resin] was changed from 20 parts to 10 parts, and [Polyester Resin 1] was replaced with [Polyester Resin 7].

Example 14

—Production of Toner 14—

[Toner 14] was obtained in the same manner as in the production of the toner in Example 1, provided that the amount of [Crystalline Resin] was changed from 20 parts to 21 parts, and [Polyester Resin 1] was replaced with [Polyester Resin 4].

Example 15

—Production of Toner 15—

[Toner 15] was obtained in the same manner as in the production of the toner in Example 1, provided that the amount of [Crystalline Resin] was changed from 20 parts to 12 parts, and [Polyester Resin 1] was replaced with [Polyester Resin 7].

Example 16

—Production of Toner 16—

[Toner 16] was obtained in the same manner as in the production of the toner in Example 1, provided that the amount of [Crystalline Resin] was changed from 20 parts to 0 parts, namely no [Crystalline Resin] was added, and [Polyester Resin 1] was replaced with [Polyester Resin 4].

Example 17

—Production of Toner 17—

[Toner 17] was obtained in the same manner as in the production of the toner in Example 1, provided that the amount of [Crystalline Resin] was changed from 20 parts to 30 parts, and [Polyester Resin 1] was replaced with [Polyester Resin 7].

Example 18

[Toner 18] was produced by an emulsion aggregation method in the following manner.

—Production of Polyester Resin Dispersion Liquid A—

To 60 parts of [Polyester Resin 1], 60 parts of ethyl acetate was added to dissolve the resin, to thereby obtain [Resin Solution]. Subsequently, 120 parts of water, 2 parts of an anionic surfactant (NEOGEN R, manufactured by DAI-ICHI KOGYO SEIYAKU CO., LTD.), and 2.4 parts of a 2% sodium hydroxide aqueous solution were mixed to thereby obtain [Aqueous Phase 18]. To 180 parts of [Aqueous Phase 18], 120 parts of [Resin Solution] was added, and the resultant mixture was emulsified by means of a homogenizer (ULTRA-TURRAX T50, manufactured by IKA Works, Inc.), followed by subjecting to an emulsification treatment using Manton-Gaulin high pressure homogenizer (manufactured by Manton-Gaulin Manufacturing Company, Inc.), to thereby obtain [Emulsified Slurry A].

Subsequently, a vessel equipped with a stirrer and a thermometer was charged with [Emulsified Slurry A], as obtained. The solvent was removed from [Emulsified Slurry A] at 30° C. over 4 hours, to thereby obtain [Polyester Resin Dispersion Liquid A]. The volume average particle diameter of the particles in [Polyester Resin Dispersion Liquid A] as obtained was measured by means of a particle size distribution analyzer (LA-920, HORIBA, Ltd.). As a result, the volume average particle diameter of the particles was 0.15 μm.

—Preparation of Release Agent Dispersion Liquid A—

Twenty five parts of paraffin wax (HNP-9, manufactured by NIPPON SEIRO CO., LTD., melting point: 75° C.), 1 part of an anionic surfactant (NEOGEN R, manufactured by DAI-ICHI KOGYO SEIYAKU CO., LTD.), and 200 parts of water, and the resultant mixture was heated at 90° C. to melt the wax. Subsequently, the resultant melt solution was emulsified by a homogenizer (ULTRA-TURRAX T50, manufactured by IKA Works, Inc.), followed by subjected to an emulsification treatment using Manton-Gaulin high pressure homogenizer (manufactured by Manton-Gaulin Manufacturing Company, Inc.), to thereby obtain [Release Agent Dispersion Liquid A].

—Preparation of Colorant Dispersion Liquid A—

Twenty parts of carbon black (Printex 35, manufactured by Evonik industries), 0.5 parts of an anionic surfactant (NEOGEN R, manufactured by DAI-ICHI KOGYO SEIYAKU CO., LTD.), and 80 parts of water, and the resultant mixture was dispersed by TK Homomixer (manufactured by PRIMIX Corporation), to thereby obtain [Colorant Dispersion Liquid A].

—Aggregation—

A vessel equipped with a thermometer and a stirrer was charged with 292 parts of [Polyester Resin Dispersion Liquid A], 45 parts of [Release Agent Dispersion Liquid A], 34 parts of [Colorant Dispersion Liquid A], and 600 parts of water, and the resultant mixture was stirred for 30 minutes at 30° C. To the resultant dispersion liquid, a 2% sodium hydroxide aqueous solution was added to adjust the pH of the dispersion liquid to 10. Subsequently, 50 parts of a 5% magnesium chloride aqueous solution was gradually added dropwise to the dispersion liquid, while stirring the dispersion liquid by a homogenizer (ULTRA-TURRAX T50, manufactured by IKA Works, Inc.) at 5,000 rpm, and heating to 45° C. The temperature was maintained at 45° C. until the volume average particle diameter of aggregated particles reached 5.1 μm. To the resultant, a 2% sodium hydroxide aqueous solution was added to maintain the pH thereof at 9, and the resultant was heated to 90° C. This state was maintained for 2 hours, followed by cooling to 20° C. at the rate of 1° C./min, to thereby obtain [Toner Slurry A].

—Removal of Solvent, Washing, and Drying—

[Toner Base Particles 18] were obtained by performing removal of the solvent, washing, drying, and air sieving on [Toner Slurry A] in the same manner as in Example 1.

—Mixing—

Hydrophobic silica was mixed under the same conditions as in Example 1, to thereby produce [Toner 18].

Example 19

[Toner 19] was produced by a dissolution suspension method in the following manner.

—Production of Oil Phase B—

A vessel equipped with a thermometer and a stirrer was charged with 129 parts of [Polyester Resin 1], 75 parts of [Wax Dispersion Liquid], 20 parts of [Master Batch], and 92 parts of ethyl acetate, and the resultant mixture was pre-mixed by a stirrer. Thereafter, the mixture was stirred by means of TK Homomixer (manufactured by PRIMIX Corporation) at the rotational speed of 5,000 rpm to homogeneously dissolve and disperse, to thereby obtain [Oil Phase B].

—Emulsification and/or Dispersion—

A fresh vessel equipped with a stirrer and a thermometer was charged with 400 parts of [Aqueous Phase 1]. To the vessel, [Oil Phase B] was added while stirring [Aqueous Phase 1] TK Homomixer (manufactured by PRIMIX Corporation) at 13,000 rpm, and emulsification was performed for 1 minute to thereby obtain [Toner Slurry B].

—Removal of Solvent, Washing, and Drying—

[Toner Base Particles 19] were obtained by performing removal of the solvent, washing, drying, and air sieving on [Toner Slurry B] in the same manner as in Example 1.

—Mixing—

Hydrophobic silica was mixed under the same conditions as in Example 1, to thereby produce [Toner 19].

Example 20

[Toner 20] was produced by a pulverization method in the following manner.

—Melt Kneading, Pulverization, and Classification—

After pre-mixing 72 parts of [Polyester Resin 1], 6 parts of paraffin wax (HNP-9, manufactured by NIPPON SEIRO CO., LTD., melting point: 75° C.), and 12 parts of [Master Batch] by means of HENSCHEL MIXER (HENSCHEL 20B, manufactured by Mitsui Mining Co., Ltd.) at 1,500 rpm for 3 minutes, the resultant mixture was melted and kneaded by means of a monoaxisual kneader (Small Buss Cokneader, manufactured by Buss) under the conditions that the set temperature of the inlet part of the monoaxial kneader was 90° C., the set temperature of the outlet part thereof was 60° C., and the feeding rate thereof was set to 10 kg/h. The obtained kneaded product was rolled and cooled, and the resultant was then roughly pulverized by a pluverizer (manufactured by Hosokawa Micron Corporation). Subsequently, the resultant was finely pulverized using a flat crush plate of I-type mill (IDS-2, manufactured by Nippon Pneumatic Mfg. Co., Ltd.) with the air pressure of 6.0 atm/cm$^2$, at the feeding rate of 0.5 kg/h. The resultant was classified by means of a classifier (132 MP, manufactured by Alpine), to thereby obtain [Toner Base Particles 20].

—Mixing—

Hydrophobic silica was mixed under the same conditions as in Example 1, to thereby produce [Toner 20].

Comparative Example 1

—Production of Toner 21—

[Polyester Resin 21] was obtained in the same manner as in the synthesis example of [Polyester Resin 1] in Example 1, provided that the molar ratio of isophthalic acid to adipic acid was changed from 70/30 to 48/52. [Toner 21] was obtained in the same manner as in the production of the toner in Example 1, provided that [Polyester Resin 1] was replaced with [Polyester Resin 21].

Comparative Example 2

—Production of Toner 22—

[Polyester Resin 22] was obtained in the same manner as in the synthesis example of [Polyester Resin 1] in Example 1, provided that the molar ratio of bisphenol A propylene oxide (2 mol) adduct to bisphenol A propylene oxide (3 mol) adduct was changed from 80/20 to 90/10, the molar ratio of isophthalic acid to adipic acid was changed from 70/30 to 90/10.

[Toner 22] was obtained in the same manner as in the production of the toner in Example 1, provided that [Polyester Resin 1] was replaced with [Polyester Resin 22].

Comparative Example 3

—Production of Toner 23—

A reaction vessel equipped with a nitrogen-inlet tube, a condenser, a stirrer, and a thermocouple was charged with bisphenol A propylene oxide (2 mol) adduct (bisPhPO2) and bisphenol A propylene oxide (3 mol) adduct (bisPhPO3) at the molar ratio (bisPhPO2/bisPhPO3) of 80/20, and isophthalic acid and adipic acid at the molar ratio (isophthalic acid/adipic acid) of 70/30, with OH/COOH of 1.33. The resultant mixture was allowed to react with 500 ppm of titanium tetraisopropxide for 10 hours at 230° C. under normal pressure. Subsequently, the resultant reaction mixture was allowed to react for 5 hours under the reduced pressure of 10 mmHg to 15 mmHg. Thereafter, 11 parts of trimellitic anhydride was added to the reaction vessel, and the resultant mixture was allowed to react for 3 hours at 180° C. under normal pressure, to thereby obtain [Polyester Resin 23].

[Toner 23] was obtained in the same manner as in the production of the toner in Example 1, provided that [Polyester Resin 1] was replaced with [Polyester Resin 23].

Comparative Example 4

—Production of Toner 24—

[Polyester Resin 24] was obtained in the same manner as in the synthesis example of [Polyester Resin 1] in Example 1, provided that the molar ratio of bisphenol A propylene oxide (2 mol) adduct to bisphenol A propylene oxide (3 mol) adduct was changed from 80/20 to 50/50, the molar ratio of isophthalic acid to adipic acid was changed from 70/30 to 100/0, and the ratio OH/COOH was changed from 1.33 to 1.29.

[Toner 24] was obtained in the same manner as in the production of the toner in Example 1, provided that [Polyester Resin 1] was replaced with [Polyester Resin 24].

Comparative Example 5

—Production of Toner 25—

[Polyester Resin 25] was obtained in the same manner as in the synthesis example of [Polyester Resin 1] in Example 1, provided that the molar ratio of isophthalic acid to adipic acid was changed from 70/30 to 50/50, and the amount of benzoic acid for use was changed from 26 parts to 11 parts. [Toner 25] was obtained in the same manner as in the production of the toner in Example 1, provided that [Polyester Resin 1] was replaced with [Polyester Resin 25].

Comparative Example 6

—Production of Toner 26—

[Polyester Resin 26] was obtained in the same manner as in the synthesis example of [Polyester Resin 1] in Example 1, provided that the molar ratio of isophthalic acid to adipic acid was changed from 70/30 to 58/42. [Toner 26] was obtained in the same manner as in the production of the toner in Example 1, provided that [Polyester Resin 1] was replaced with [Polyester Resin 26].

Comparative Example 7

—Production of Toner 27—

[Polyester Resin 27] was obtained in the same manner as in the synthesis example of [Polyester Resin 1] in Example 1, provided that the molar ratio of isophthalic acid to adipic acid was changed from 70/30 to 48/52, and the amount of benzoic acid for use was changed from 26 parts to 21 parts. [Toner 27] was obtained in the same manner as in the production of the toner in Example 1, provided that [Polyester Resin 1] was replaced with [Polyester Resin 27].

(Measurements)

The toners obtained in Examples and Comparative Examples above were subjected to the following measurements.

The toner (2 g) was placed in a thimble having an internal diameter of 24 mm, which is then set in the extraction tube. The flask is charged with 200 mL of THF, followed by performing Soxhlet extraction for 10 hours. As for the Soxhlet extraction, the Soxhlet extractor illustrated in FIG. 1 was used. One set of the flask equipped with the condenser was placed in a heating mantle, and the THF was allowed to reflux at 80° C., to add the THF dripped from the condenser to the toner dropwise. The THF-soluble components in the toner were allowed to be extracted in the flask to obtain an extraction liquid. The extraction liquid was dried for 48 hours at 38° C. to thereby obtain [Extract].

[Extract] as obtained was subjected to a measurement of glass transition temperature Tg by means of DSC-6220R (manufactured by Seiko instruments Inc.). First, the sample was heated from room temperature to 150° C. at the heating rate of 10° C./min, followed by leaving to stand for 10 minutes at 150° C. Subsequently, the sample was cooled to the room temperature, followed by leaving to stand for 10 minutes. Thereafter, the sample was again heated to 150° C. at the heating rate of 10° C./min. In the resultant DSC curve, the glass transition temperature can be determined from the base line at a temperature equal to or lower than the glass transition temperature and a curved line portion at a height which corresponds to ½ of the distance from the base line at a temperature equal to or lower than the glass transition temperature to the base line at a temperature equal to or higher than the glass transition temperature.

[Extract] obtained above was ground by a mortar. The particle diameter of the ground product was adjusted to 150 μm using a 100-mesh, and the resultant was dried by a vacuum dryer for 4 hours at 40° C. Thereafter, the dried product was left to stand for 3 days in the environment of 40° C. and 70% RH. The moisture-content change rate was determined with the following formula. Note that, a digital precision balance (ER-180A, manufactured by A&D Company, Limited) was used for the measurement of the weight.

Moisture-content change rate (%)=(weight after leaving to stand−weight before leaving to stand)/weight before leaving to stand×100

Each of the toners obtained in Examples and Comparative Examples was left to stand for 3 days in the environment of 40° C. and 70% RH. The specific surface area change rate after leaving to stand was determined with the following formula.

Toner specific surface area change rate (%)=(BET specific surface area before storage−BET specific surface area after storage)/BET specific surface area before storage×100

The molecular weight distribution and weight average molecular weight (Mw) of each of the toners obtained in Examples and Comparative Examples above, which could be determined by GPC of the THF-soluble components in the toner, were measured in the following manner.

Gel permeation chromatography (GPC) measuring device: GPC-8220GPC (manufactured by Tosoh Corporation)

Column: TSK-GEL SUPER HZ2000, TSK-GEL SUPER HZ2500, and TSK-GEL SUPER HZ3000

Temperature: 40° C.

Solvent: tetrahydrofuran (THF)

Flow rate: 0.35 mL/min

Sample: THF sample solution having a concentration adjusted to 0.15% by mass

Pretreatment of sample: a toner was dissolved in THF (containing a stabilizer, manufactured by Wako Pure Chemical Industries, Ltd.) at 0.15% by mass, followed by filtering through a 0.45 μm filter. The resultant filtrate was used as the sample.

The measurement was performed by injecting 10 μL to 200 μL of the THF sample solution. As for the measurement of the weight average molecular weight (Mw), a molecular weight distribution of the sample was calculated from the relationship between the number of counts and the logarithmic value of the calibration curve prepared from a several monodisperse polystyrene standard samples. As for the polystyrene standard samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene were used. As for the detector, a refractive index (RI) detector was used.

For the GPC measurement results, a molecular weight distribution curve was plotted by taking an intensity as a vertical axis and a molecular weight as a horizontal axis, and peak intensities throughout the molecular weight distribution curve were corrected assuming the maximum peak value in molecular weights of 20,000 or less was 100. Next, a difference between the maximum value and the minimum value among peak intensities in the range of the molecular weight M±300 for molecular weights in a range of from 300 through 5,000 was determined. Note that, the difference between GPC peak intensities described in the following Table 1-2 is the maximum value used for determining the difference.

The measurement of an absorption peak of each of the toners of Examples and Comparative Examples above was performed by means of a differential scanning calorimeter (DSC-6220R, manufactured by Seiko instruments Inc.). The conditions for the measurement were the same as the conditions for the measurement of the glass transition temperature described above.

The obtained results are presented in Table 1-2.

TABLE 1-1

| | Polyester resin | | | | |
|---|---|---|---|---|---|
| | OH/COOH | Benzoic acid (parts) | bisPhAPO2/bisPhAPO3 | Isophthalic acid/adipic acid | Crystalline resin (parts) |
| Ex. 1 | 1.33 | 26 | 80/20 | 70/30 | 20 |
| Ex. 2 | 1.33 | 21 | 80/20 | 70/30 | 20 |
| Ex. 3 | 1.33 | 16 | 80/20 | 70/30 | 20 |
| Ex. 4 | 1.33 | 26 | 80/20 | 50/50 | 20 |
| Ex. 5 | 1.33 | 21 | 80/20 | 50/50 | 20 |
| Ex. 6 | 1.33 | 16 | 80/20 | 50/50 | 20 |
| Ex. 7 | 1.33 | 26 | 80/20 | 80/20 | 20 |
| Ex. 8 | 1.33 | 21 | 80/20 | 80/20 | 20 |
| Ex. 9 | 1.33 | 16 | 80/20 | 80/20 | 20 |
| Ex. 10 | 1.35 | 26 | 80/20 | 70/30 | 20 |
| Ex. 11 | 1.31 | 26 | 80/20 | 70/30 | 20 |
| Ex. 12 | 1.33 | 26 | 80/20 | 50/50 | 23 |
| Ex. 13 | 1.33 | 26 | 80/20 | 80/20 | 10 |
| Ex. 14 | 1.33 | 26 | 80/20 | 50/50 | 21 |
| Ex. 15 | 1.33 | 26 | 80/20 | 80/20 | 12 |
| Ex. 16 | 1.33 | 26 | 80/20 | 50/50 | 0 |
| Ex. 17 | 1.33 | 26 | 80/20 | 80/20 | 30 |
| Ex. 18 | — | — | — | — | — |
| Ex. 19 | — | — | — | — | — |
| Ex. 20 | — | — | — | — | — |
| Comp. Ex. 1 | 1.33 | 26 | 80/20 | 48/52 | 20 |
| Comp. Ex. 2 | 1.33 | 26 | 90/10 | 90/10 | 20 |
| Comp. Ex. 3 | 1.33 | Trimellitic anhydride 11 | 80/20 | 70/30 | 20 |
| Comp. Ex. 4 | 1.29 | 26 | 50/50 | 100/0 | 20 |
| Comp. Ex. 5 | 1.33 | 11 | 80/20 | 50/50 | 20 |
| Comp. Ex. 6 | 1.33 | 26 | 80/20 | 58/42 | 20 |
| Comp. Ex. 7 | 1.33 | 21 | 80/20 | 48/52 | 20 |

TABLE 1-2

| | Tg of toner extract (° C.) | Moisture content change rate of toner extract (%) | Specific surface area change rate of toner (%) | Mw | Difference between max value and min value of peak intensities in molecular weight M ± 300 | Endothermic peak for first heating in DSC (° C.) | Endothermic peak for second heating in DSC (° C.) |
|---|---|---|---|---|---|---|---|
| Ex. 1 | 45 | 0.1 | 25 | 4,500 | 9 | 52 | 32 |
| Ex. 2 | 46 | 0.3 | 30 | 4,520 | 18 | 53 | 33 |
| Ex. 3 | 44 | 0.5 | 35 | 4,470 | 27 | 51 | 31 |
| Ex. 4 | 35 | 0.0 | 40 | 4,530 | 11 | 42 | 22 |

TABLE 1-2-continued

| | Tg of toner extract (° C.) | Moisture content change rate of toner extract (%) | Specific surface area change rate of toner (%) | Mw | Difference between max value and min value of peak intensities in molecular weight M ± 300 | Endothermic peak for first heating in DSC (° C.) | Endothermic peak for second heating in DSC (° C.) |
|---|---|---|---|---|---|---|---|
| Ex. 5 | 35 | 0.3 | 45 | 4,480 | 21 | 42 | 22 |
| Ex. 6 | 36 | 0.5 | 50 | 4,500 | 30 | 43 | 23 |
| Ex. 7 | 54 | 0.1 | 15 | 4,460 | 10 | 61 | 41 |
| Ex. 8 | 55 | 0.3 | 20 | 4,500 | 22 | 62 | 42 |
| Ex. 9 | 55 | 0.5 | 25 | 4,510 | 32 | 62 | 42 |
| Ex. 10 | 44 | 0.3 | 50 | 3,200 | 42 | 51 | 31 |
| Ex. 11 | 45 | 0.0 | 15 | 5,320 | 23 | 52 | 32 |
| Ex. 12 | 35 | 0.2 | 40 | 4,530 | 11 | 39 | 19 |
| Ex. 13 | 55 | 0.1 | 15 | 4,460 | 10 | 71 | 51 |
| Ex. 14 | 35 | 0.2 | 38 | 4,530 | 11 | 41 | 21 |
| Ex. 15 | 55 | 0.1 | 17 | 4,460 | 10 | 70 | 50 |
| Ex. 16 | 35 | 0.1 | 15 | 4,530 | 11 | 42 | 22 |
| Ex. 17 | 55 | 0.5 | 50 | 4,480 | 10 | 57 | 37 |
| Ex. 18 | 45 | 0.1 | 28 | 4,530 | 9 | 42 | 22 |
| Ex. 19 | 45 | 0.1 | 31 | 4,500 | 9 | 45 | 25 |
| Ex. 20 | 45 | 0.1 | 17 | 4,510 | 9 | 41 | 21 |
| Comp. Ex. 1 | 34 | 0.0 | 50 | 4,480 | 23 | 41 | 21 |
| Comp. Ex. 2 | 56 | 0.3 | 18 | 4,500 | 28 | 63 | 43 |
| Comp. Ex. 3 | 45 | 0.6 | 40 | 4,510 | 60 | 52 | 32 |
| Comp. Ex. 4 | 63 | 0.2 | 14 | 5,220 | 22 | 70 | 50 |
| Comp. Ex. 5 | 35 | 0.5 | 51 | 4,490 | 48 | 42 | 22 |
| Comp. Ex. 6 | 35 | 0.8 | 65 | 4,520 | 84 | 42 | 22 |
| Comp. Ex. 7 | 34 | 0.3 | 52 | 4,540 | 33 | 41 | 21 |

(Evaluation Items)

The toners obtained in Examples and Comparative Examples above were evaluated in the following manners.

<Low Temperature Fixing Ability>

A non-fixed image was formed by a copier (IMAGIO NEO C355) manufactured by Ricoh Company Limited using a two-component toner including the toner obtained above at the deposition amount of 4.0 mg/cm$^2$. Subsequently, the image was fixed by means of an external fixing device, which was modified from a fixing device (oil-less system) of the copier (IMAGIO NEO C355) manufactured by Ricoh Company Limited, and could freely set the temperature of a roller, with fixing the paper feeding speed with 120 mm/sec, and changing the temperature from 100° C. to 140° C. by 1° C. Whether an offset phenomenon occurred was observed on the fixing roller and on the paper. The offset phenomenon is a phenomenon that the toner is not sufficiently melted to thereby retransfer the image on a non-imaging area. The temperature at which the image was not retransferred was determined as a non-offset temperature at the low temperature side.

The evaluation criteria was as follows.

A: The non-offset temperature was lower than 120° C.

B: The non-offset temperature was 120° C. or higher but lower than 130° C.

C: The non-offset temperature was 130° C. or higher.

<Storage Stability (Heat Resistant Storage Stability)>

The toner was weighted in a 200 cc screw vial by 10 g, and was left to stand for 2 weeks in the environment of 40° C. and 70%, to thereby prepare the toner for evaluation. The toner for evaluation was scattered on a mesh having an opening size of 75 μm, sieved for 1 minute, and then a state of the toner remained on the sieve was observed.

The evaluation criteria was as follows.

A: An aggregation of the toner particles was not observed at all.

B: An aggregation of the toner particles was slightly observed.

C: Many aggregated toner particles were observed across the sample.

<Charging Ability (Reduction of Charge after High Temperature and High Humidity Storage)>

After conditioning with an open system for 30 minutes or longer in a room of normal temperature and normal humidity (temperature: 23.5° C., humidity: 55% RH), an initial carrier (6.000 g) and toner (0.452 g) were added to a stainless steel vessel. The vessel was then sealed, and was shaken by operating YS-LD (shaker, manufactured by Yayoi Co., Ltd.) for 1 minute with a dial of 150, with an amplitude of about 1,100 times, to thereby charge the sample through frictions. The charged sample was then measured by a typical blow-off method (TB-200, manufactured by KYOCERA Chemical Corporation). Moreover, the sample was conditioned with an open system for 3 days under high temperature high humidity conditions (temperature: 40° C., humidity: 70% RH), followed by conditioning with an open system for 30 minutes or longer in a room of normal temperature and normal humidity (temperature: 23.5° C., humidity: 55% RH). Then, the sample was measured in the same manner as described above. The charge amount change rate of the toner was calculated as follows.

Charge amount change rate (%) of toner=(charge amount before storage−charge amount after high temperature high humidity storage)/charge amount before storage×100

The evaluation criteria was as follows.

A: The charge amount change rate of the toner was less than 15%.

B: The charge amount change rate of the toner was 15% or greater but less than 20%.

C: The charge amount change rate of the toner was 20% or greater.

The evaluation results of Examples and Comparative Examples of the present invention are presented in Table 2.

<Overall Evaluation>

Based on the above evaluation results, overall evaluation was performed according to the following evaluation criteria.

A: Excellent

B: Acceptable

C: Not Acceptable

TABLE 2

| | | Low temperature fixing ability | Heat resistant storage stability | Reduction of charge after high temperature high humidity storage | Overall judgement |
|---|---|---|---|---|---|
| Ex. 1 | Toner 1 | A | A | A | A |
| Ex. 2 | Toner 2 | A | A | B | A |
| Ex. 3 | Toner 3 | A | A | B | A |
| Ex. 4 | Toner 4 | A | A | A | A |
| Ex. 5 | Toner 5 | A | A | B | A |
| Ex. 6 | Toner 6 | A | B | B | B |
| Ex. 7 | Toner 7 | B | A | A | A |
| Ex. 8 | Toner 8 | B | A | A | A |
| Ex. 9 | Toner 9 | B | A | B | B |
| Ex. 10 | Toner 10 | A | A | B | B |
| Ex. 11 | Toner 11 | A | B | B | B |
| Ex. 12 | Toner 12 | B | A | B | B |
| Ex. 13 | Toner 13 | B | B | A | B |
| Ex. 14 | Toner 14 | A | B | B | B |
| Ex. 15 | Toner 15 | B | A | A | B |
| Ex. 16 | Toner 16 | B | A | A | B |
| Ex. 17 | Toner 17 | A | B | B | B |
| Ex. 18 | Toner 18 | B | A | B | B |
| Ex. 19 | Toner 19 | B | A | B | B |
| Ex. 20 | Toner 20 | B | A | B | B |
| Comp. Ex. 1 | Toner 21 | A | C | C | C |
| Comp. Ex. 2 | Toner 22 | C | A | A | C |
| Comp. Ex. 3 | Toner 23 | A | B | C | C |
| Comp. Ex. 4 | Toner 24 | C | A | A | C |
| Comp. Ex. 5 | Toner 25 | A | C | C | C |
| Comp. Ex. 6 | Toner 26 | A | C | C | C |
| Comp. Ex. 7 | Toner 27 | A | C | C | C |

What is claimed is:

1. A toner comprising:

a binder resin comprising a crystalline polyester resin and an amorphous polyester resin, the amorphous polyester resin having a terminal group blocked with benzoic acid, wherein:

the toner has an endothermic peak in a range of from 40° C. through 70° C. at a first heating, and an endothermic peak in a range of from 20° C. through 50° C. at a second heating, as measured by differential scanning calorimetry (DSC), a toner extract obtained by drying an extraction liquid obtained through Soxhlet extraction of the toner with tetrahydrofuran (THF) has glass transition temperature Tg in a range of from 35° C. through 55° C., and a moisture-content change rate of the toner extract before and after leaving the toner extract to stand for 3 days in an environment of 40° C. and 70% RH calculated as:

moisture-content change rate (%)=((weight after leaving to stand-weight before leaving to stand)/weight before leaving to stand)×100 is 0.5% or less, and a specific-surface-area change rate of the toner before and after leaving the toner to stand for 3 days in an environment of 40° C. and 70% RH calculated as:

toner specific surface area change rate (%)=((BET specific surface area before storage-BET specific surface area after storage)/BET specific surface area before storage)×100 is in a range of from 15% through 50%.

2. A toner stored unit comprising:

a toner stored in the toner stored unit, wherein the toner is the toner of claim 1.

3. The toner according to claim 1, wherein the binder resin further comprises a urea-modified polyester resin.

4. The toner according to claim 1, wherein a ratio (Dw/Dn) of a weight average particle diameter (Dw) of the toner to a number average particle diameter (Dn) of the toner is 1.00-1.20.

5. An image forming apparatus comprising:

an electrostatic latent image bearer;

an electrostatic latent image forming unit configured to form an electrostatic latent image on the electrostatic latent image bearer;

a developing unit containing a toner and configured to develop the electrostatic latent image with the toner to form a visible image;

a transferring unit configured to transfer the visible image onto a recording medium to form a transferred image; and a fixing unit configured to fix the transferred image on the recording medium, wherein the toner is the toner of claim 1.

* * * * *